US011096535B2

(12) United States Patent
Koura et al.

(10) Patent No.: US 11,096,535 B2
(45) Date of Patent: Aug. 24, 2021

(54) ROBOTIC VACUUM

(71) Applicant: MAKITA CORPORATION, Anjo (JP)

(72) Inventors: Kentaro Koura, Anjo (JP); Yudai Sugino, Anjo (JP); Hirotaka Sumiyoshi, Anjo (JP)

(73) Assignee: MAKITA CORPORATION, Anjo (JP)

( * ) Notice: Subject to any disclaimer, the term of this patent is extended or adjusted under 35 U.S.C. 154(b) by 284 days.

(21) Appl. No.: 16/415,012

(22) Filed: May 17, 2019

(65) Prior Publication Data

US 2019/0357743 A1 Nov. 28, 2019

(30) Foreign Application Priority Data

May 23, 2018 (JP) ..... JP2018-098856

(51) Int. Cl.
*A47L 9/00* (2006.01)
*A47L 9/28* (2006.01)

(52) U.S. Cl.
CPC ..... *A47L 9/009* (2013.01); *A47L 9/2884* (2013.01); *A47L 2201/00* (2013.01)

(58) Field of Classification Search
CPC .. A47L 2201/00; A47L 2201/06; A47L 9/009; A47L 9/0488; A47L 9/2857; A47L 9/2884
See application file for complete search history.

(56) References Cited

U.S. PATENT DOCUMENTS 5,109,566 A * 5/1992 Kobayashi ..... A47L 11/4011 15/319
6,553,612 B1 * 4/2003 Dyson ..... A47L 5/28 15/340.1
6,581,239 B1 * 6/2003 Dyson ..... A47L 5/34 15/340.3

(Continued)

FOREIGN PATENT DOCUMENTS

CN 103813742 A 5/2014
CN 103813742 A 5/2014

(Continued)

OTHER PUBLICATIONS

JP-2018007849-A—English Machine Translation (Year: 2018).*

(Continued)

*Primary Examiner* — Marc Carlson
(74) *Attorney, Agent, or Firm* — J-Tek Law PLLC; Jeffrey D. Tekanic; Scott T. Wakeman

(57) ABSTRACT

A robotic vacuum (1) includes a main body (2) having a suction port (15) in a bottom surface (2B) thereof; a storage unit (6) housed in the main body and configured to store dust and debris suctioned in via the suction port (15); and at least one wheel (9) that supports the main body (2). The main body (2) has a width Wb in a first direction that is parallel to a rotational axis (AX) of the wheel (9), the storage unit (6) has a width Ws in the first direction, the main body (2) has a height Hb in a second direction that is perpendicular to the rotational axis (AX) and perpendicular to the first direction, (Continued)

and the storage unit (6) has a height Hs in the second direction. The width Wb is 470-600 mm, and the condition $0.5 \times Wb \leq Ws \leq 0.7 \times Wb$ is satisfied.

19 Claims, 9 Drawing Sheets

(56) References Cited

U.S. PATENT DOCUMENTS

| | | | | |
|---|---|---|---|---|
| 7,492,124 | B2 | 2/2009 | Johnson et al. | |
| 7,769,490 | B2 * | 8/2010 | Abramson | A47L 5/22 700/245 |
| 9,532,688 | B1 | 1/2017 | Afrouzi et al. | |
| 2003/0060928 | A1 * | 3/2003 | Abramson | G05D 1/0219 700/245 |
| 2008/0052867 | A1 * | 3/2008 | Park, II | A47L 9/009 15/319 |
| 2008/0062618 | A1 | 3/2008 | Frank et al. | |
| 2008/0276407 | A1 * | 11/2008 | Schnittman | A47L 11/4025 15/319 |
| 2008/0281470 | A1 | 11/2008 | Gilbert et al. | |
| 2009/0307865 | A1 | 12/2009 | Williamson et al. | |
| 2010/0088843 | A1 | 4/2010 | Reed et al. | |
| 2012/0011668 | A1 | 1/2012 | Schnittman et al. | |
| 2012/0112689 | A1 | 5/2012 | Sever et al. | |
| 2012/0265343 | A1 | 10/2012 | Gilbert et al. | |
| 2013/0117952 | A1 | 5/2013 | Schnittman et al. | |
| 2015/0214758 | A1 | 7/2015 | Toya et al. | |
| 2015/0366133 | A1 | 12/2015 | Nojiri et al. | |
| 2016/0095487 | A1 * | 4/2016 | Koura | A47L 9/2868 15/383 |

FOREIGN PATENT DOCUMENTS

| | | | |
|---|---|---|---|
| CN | 206285064 | U | 6/2017 |
| CN | 206285064 | U | 6/2017 |
| CN | 206809235 | U | 12/2017 |
| CN | 206809235 | U | 12/2017 |
| CN | 107913034 | A | 4/2018 |
| CN | 107913034 | A | 4/2018 |
| DE | 69910252 | | 7/2004 |
| DE | 102011004319 | A1 | 8/2012 |
| JP | S63311923 | A | 12/1988 |
| JP | H02241423 | A | 9/1990 |
| JP | H0453515 | A | 2/1992 |
| JP | H0588472 | U | 12/1993 |
| JP | 2002532178 | A | 10/2002 |
| JP | 2002360479 | A | 12/2002 |
| JP | 2002360480 | A | 12/2002 |
| JP | 2006043302 | A | 2/2006 |
| JP | 2008155041 | A | 7/2008 |
| JP | 2013239259 | A | 11/2013 |
| JP | 2014030484 | A | 2/2014 |
| JP | 2014036750 | A | 2/2014 |
| JP | 2014083241 | A | 5/2014 |
| JP | 2014111190 | A | 6/2014 |
| JP | 2014147904 | A | 8/2014 |
| JP | 2014180501 | A | 9/2014 |
| JP | 2015093129 | A | 5/2015 |
| JP | 2015093129 | A | 5/2015 |
| JP | 2018007849 | A | 1/2018 |
| JP | 2018007849 | A * | 1/2018 |
| WO | 0036962 | A1 | 6/2000 |
| WO | 0038255 | A1 | 6/2000 |
| WO | 2014021116 | A1 | 2/2014 |
| WO | 2014119160 | A1 | 8/2014 |
| WO | 2014119732 | A1 | 8/2014 |
| WO | 2014155904 | A1 | 10/2014 |

OTHER PUBLICATIONS

Robot® Roomba® 400 Series Owner's manual having created date of Mar. 29, 2010.

Robot® Roomba® 500 Series Owner's manual having created date of Mar. 22, 2010.

Robot® Roomba® 600 Series Owner's manual having created date of Sep. 20, 2012.

Robot® Roomba® 700 Series Owner's manual having created date of Dec. 17, 2012.

Robot® Roomba® 800 Series Owner's manual having created date of Mar. 7, 2014.

Müheloses Gärtnem (easy gardening), Bosch-Gartengeräte 2013, Robert Bosch GmbH Power Tools, D-70745 Leinfelden Echterdingen (p. 69).

Office Action and Search Report from the Chinese Patent Office dated May 7, 2021 in counterpart Chinese application No. CN 201910288903. 7, and machine translation thereof.

* cited by examiner

ROBOTIC VACUUM

CROSS-REFERENCE

The present application claims priority to Japanese patent application serial number 2018-098856 filed on May 23, 2018, the contents of which are incorporated fully herein by reference.

TECHNICAL FIELD

The present invention generally relates to a robotic vacuum (also known as a robotic dust collector, robotic vacuum cleaner or robotic cleaner).

BACKGROUND ART

Robotic vacuums are used in cleaning work to collect dust, debris, etc. while traveling autonomously. Robotic vacuums for home use and robotic vacuums for business use are known examples of robotic vacuums. One example of a robotic vacuum (an electronic vacuum cleaner) for home use is disclosed in Japanese Laid-open Patent Publication 2018-007849.

SUMMARY OF THE INVENTION

Robotic vacuums for business use are required to clean large area surfaces, such as, for example, the floor surface of an airport, a warehouse, a store, etc. Robotic vacuums for business use may be much larger than robotic vacuums for home use. In addition, the operation of a robotic vacuum for business use also may be more complicated than a robotic vacuum for home use. Thus, there is a demand for a business use robotic vacuum that can easily clean a surface of an area larger than that of a home, such as the floor surface of a store or of an office, in a convenient manner.

It is one non-limiting object of the present teachings to disclose a robotic vacuum that can easily and reliably clean a large area surface.

According to one aspect of the present teachings, a robotic vacuum (robotic dust collector or robotic cleaner) is provided that comprises: a main body having a suction port (opening) in a bottom surface (bottom plate); a storage unit (dust box or dust bin), which is housed in the main body and stores (holds) dust, debris, etc., suctioned in via the suction port; and a (at least one) wheel, which supports the main body and at least a portion of which protrudes beyond (below) the bottom surface. The width of the main body, which is a dimension in a direction parallel to a rotational axis of the wheel, is represented as Wb, the width of the storage unit is represented as Ws, the height of the main body, which is a dimension in a direction orthogonal to the rotational axis, is represented as Hb, and the height of the storage unit is represented as Hs. Preferably, the width Wb is 470 mm or more and 600 mm or less and the condition $0.5 \times Wb \leq Ws \leq 0.7 \times Wb$ is satisfied.

Additional aspects, embodiments, advantages and effects of the invention will become apparent upon reading the following description in view of the appended Figures and claims.

DETAILED DESCRIPTION OF EXEMPLARY EMBODIMENTS OF THE INVENTION

First Embodiment

Figure 1:
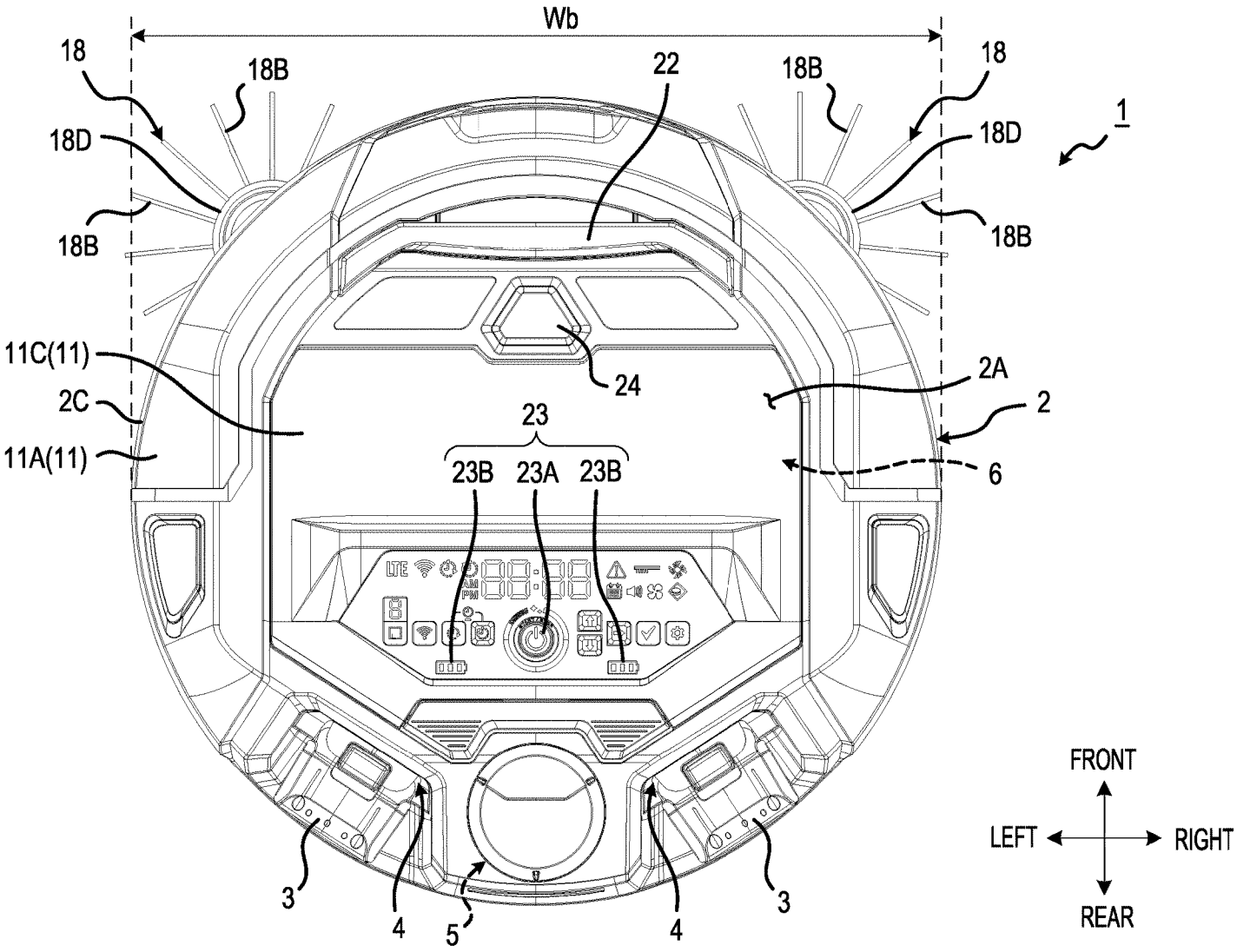
FIG. 1 is a top view that shows a robotic vacuum according to a first non-limiting, exemplary embodiment of the present teachings.
Figure 2:
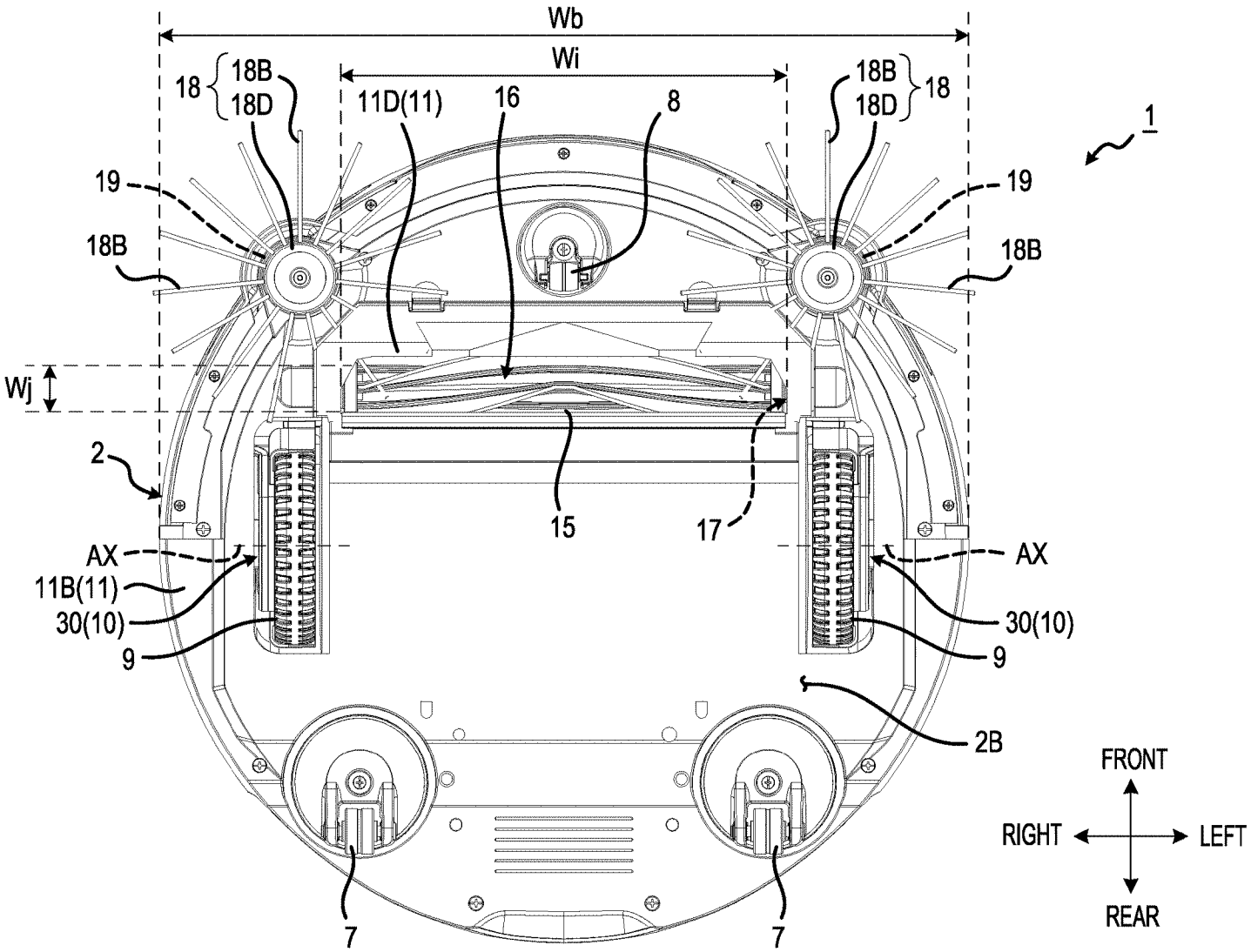
FIG. 2 is a bottom view that shows the robotic vacuum according to the first exemplary embodiment.
Figure 3:
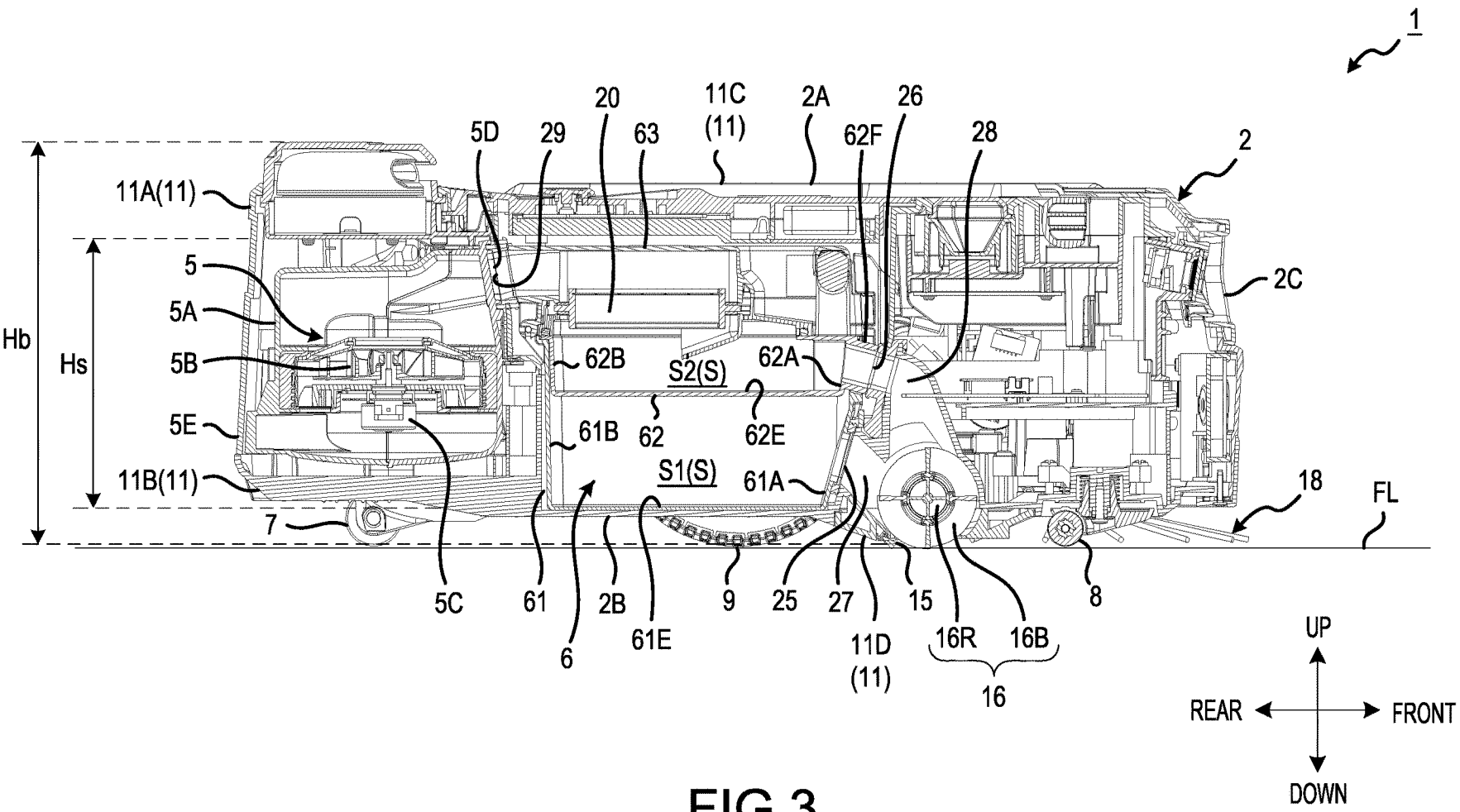
FIG. 3 is a side cross sectional view that shows the robotic vacuum according to the first exemplary embodiment.

FIG. 1 is a top view that shows a representative, non-limiting robotic vacuum (also known as a robotic dust collector, robotic cleaner or robotic vacuum cleaner) 1 according to a first embodiment of the present teachings. FIG. 2 is a bottom view that shows the robotic vacuum 1 according to the present embodiment. FIG. 3 is a side cross sectional view that shows the robotic vacuum 1 according to the present embodiment.

In the present embodiment, the positional relationships among the parts will be explained using the terms "left," "right," "front," "rear," "up," and "down." These terms indicate relative position or direction, using a center part/point of the robotic vacuum 1 as a reference.

The robotic vacuum 1 collects (suctions, vacuums) dust, debris, etc. while traveling autonomously on a surface to be cleaned, such as a floor FL. As shown in FIGS. 1-3, the robotic vacuum 1 comprises: a main body 2, which has a suction port (main brush opening) 15; one or more (e.g., two) battery mounting parts 4, which is/are provided on the main body 2 and on which one or more rechargeable batteries 3 (e.g., two) is/are (respectively) mounted; a fan unit 5, which is housed in the main body 2 and generates a suction force for suctioning dust, debris, etc.; a storage unit 6, which is housed in the main body 2 and stores dust, debris, etc.; two castors 7 and a roller 8, which are rotatably supported on the main body 2; two wheels 9, which movably support the main body 2; two wheel motors 10, which generate motive power and respectively rotate the two wheels 9; and two suspension apparatuses 30, which respectively support the two wheels 9 so as to be movable in the up-down direction (i.e. perpendicular to the rotational axis AX of the wheels 9).

In addition, the robotic vacuum 1 comprises: a main brush 16, which is rotatably disposed in the suction port 15; a main brush motor 17, which generates motive power that rotates the main brush 16; side brushes 18, which are disposed on a front part of the main body 2; and side brush motors 19, which generate motive power and respectively rotate the side brushes 18.

In addition, the robotic vacuum 1 comprises a handle 22, which is pivotably coupled to the main body 2 and is capable of being held by a user, as well as a user interface (interface apparatus) 23.

The main body 2 has an upper surface 2A; a bottom surface 2B, which opposes the surface to be cleaned FL; and a side surface 2C, which connects a circumferential edge portion of the upper surface 2A to a circumferential edge portion of the bottom surface 2B. The outer shape (contour) of the main body 2 is substantially circular within a plane that is parallel to the upper surface 2A (i.e. in a plane parallel to the rotational axis AX).

The main body 2 comprises a housing 11, which has an interior space. The housing 11 comprises: an upper housing 11A; a lower housing 11B, which is disposed downward of and is connected to the upper housing 11A; a cover plate 11C, which is detachably mounted on the upper housing 11A; and a bottom plate 11D, which is mounted on the lower housing 11B. The upper surface 2A spans the upper housing 11A and the cover plate 11C. The bottom surface 2B spans the lower housing 11B and the bottom plate 11D.

The bottom surface 2B of the main body 2 has the suction port (main brush opening) 15 provided in the bottom plate 11D. The suction port 15 suctions in dust, debris, etc. from the opposing surface to be cleaned FL. The suction port 15 is provided in (at) a front portion of the bottom surface 2B. The suction port 15 has a rectangular shape that is elongated in a left-right direction. In the left-right direction, the center of the suction port 15 coincides with the center of the main body 2. It is noted that the center of the suction port 15 need not coincide with the center of the main body 2 in alternate embodiments of the present teachings.

The two battery mounting parts 4 are provided on at least a portion of an outer surface of the main body 2. Recessed parts (recesses) are provided on (in) a rear part of the upper housing 11A. The battery mounting parts 4 are respectively provided on inner (radially inward) sides of the recessed parts (recesses) of the upper housing 11A. One of the battery mounting parts 4 is provided leftward of the fan unit 5 and the other battery mounting part 4 is provided rightward of the fan unit 5.

The batteries (also known as battery packs or battery cartridges) 3, when mounted on the battery mounting parts 4, supply electric current (power) to the electrical components installed in the robotic vacuum 1. The batteries 3 preferably may be batteries (battery packs, battery cartridges) that are designed for use with power tools. The batteries 3 may be (or may contain) lithium ion batteries that are commonly used as the power supply for power tools. The batteries 3 are preferably rechargeable batteries. The battery mounting parts 4 each have a structure that is equivalent to the battery mounting part of a power tool. Preferably, the two batteries are 18-36 volt battery cartridges having at least 3.0 ampere-hours (Ah) of charge storage capacity.

The user can mount the batteries 3 on the battery mounting parts 4 and remove the batteries 3 from the battery mounting parts 4 in the exterior space defined by the housing 11. The battery mounting parts 4 preferably each have one or more guide members (e.g., rails), which guide(s) and retain(s) the corresponding battery 3 being mounted therein; and main body terminals (electrical contacts), which are designed to electrically connect to corresponding battery terminals provided on the mounted battery 3. The user can mount the batteries 3 on the battery mounting parts 4 by inserting the batteries 3 into the battery mounting parts 4 from above while being guided by the guide member(s). When each of the batteries 3 is mounted on the respective battery mounting part 4, the battery terminals of the battery 3 electrically connect with the main body terminals of the battery mounting parts 4. The user can remove the batteries 3 from the battery mounting parts 4 by moving the batteries 3 upward.

Referring now to FIG. 3, the fan unit 5 generates a suction force for suctioning dust, debris, etc. into the suction port 15. The fan unit 5 is disposed in the interior space of the housing 11 between the two battery mounting parts 4 in a rear part of the main body 2. The fan unit 5 is fluidly connected to (in fluid communication with) the suction port 15 via the storage unit 6. Thus, the fan unit 5 generates the suction force at (in) the suction port 15 via the storage unit 6.

The fan unit 5 comprises: a casing 5A, which is disposed in the interior space of the housing 11; a suction fan 5B, which is provided in the interior of the casing 5A; and a suction motor 5C, which generates motive power that rotates the suction fan 5B. The casing 5A has an air suction port 5D, which is fluidly connected to (in fluid communication with) the storage unit 6, and an exhaust port 5E.

The suction motor 5C operates using electric power supplied from the batteries 3. When the suction motor 5C operates and the suction fan 5B rotates, an airflow is generated from the air suction port 5D toward the exhaust port 5E. The air suction port 5D is fluidly connected to (in fluid communication with) the suction port 15 via the storage unit 6. Consequently, when the suction fan 5B rotates, the airflow is generated from the suction port 15 toward the exhaust port 5E thereby generating a suction force at (in) the suction port 15.

The storage unit 6 is housed in the main body 2. More specifically, the storage unit 6 is disposed in the interior space of the housing 11 between the suction port 15 and the fan unit 5. The storage unit 6 collects and stores the dust, debris, etc. that was suctioned in through the suction port 15, as will be further discussed below.

Referring now to FIG. 2, the two castors 7 and the roller 8 movably support the main body 2 and are rotatably supported (mounted) on the main body 2. The two castors 7 are provided on the rear part of the bottom surface 2B. One of the castors 7 is provided on a left part of the main body 2 and the other castor 7 is provided on a right part of the main body 2. The single roller 8 is provided on the front part of the bottom surface 2B.

The two wheels 9 moveably support the main body 2 and are independently rotated by the two wheel motors 10. The wheels 9 rotate about a rotational axis AX that extends in the left-right direction. In the present embodiment, the left-right direction is parallel to the rotational axis AX.

At least a portion of each wheel 9 protrudes downward beyond (below) the bottom surface 2B. The robotic vacuum 1 travels autonomously by rotating the two wheels 9. One of the wheels 9 is provided on the left part (side) of the main body 2 and the other wheel 9 is provided on the right part (side) of the main body 2.

The wheel motors 10 generate motive power using electric power supplied from the batteries 3 and respectively (independently) rotate the wheels 9. The two wheel motors 10 are provided in the interior space of the housing 11. One of the wheel motors 10 generates motive power that rotates the wheel 9 provided on the left part (side) of the main body 2. The other wheel motor 10 generates motive power that rotates the wheel 9 provided on the right part (side) of the main body 2. The wheel motors 10 are capable of changing the rotational direction of the respective wheels 9, i.e. each wheel 9 may be independently rotated frontward (e.g., clockwise) or rearward (e.g., counterclockwise) in order to change the movement direction of the robotic vacuum 1. For example, the robotic vacuum 1 advances forward by rotating both of the wheels 9 in one (forward) direction. On the other hand, the robotic vacuum 1 moves backward by rotating both of the wheels 9 in the other (rearward) direction. The two wheel motors 10 are operable individually with (at) differing operating amounts, which enables the robotic vacuum 1 to spin about its center point or move in a direction oblique to its front-rear direction. For example, the robotic vacuum 1 turns (spins) by operating the two wheel motors 10 with (at) differing operating amounts (e.g., differing speeds) and/or in different rotational directions.

The suspension apparatuses 30 respectively support the wheels 9 so that the wheels 9 are independently moveable in the up-down direction. In addition, the suspension apparatuses 30 rotatably support the wheels 9 about the rotational axis AX.

The suspension apparatuses 30 are coupled (connected, attached) to the main body 2. At least a portion of each suspension apparatus 30 is disposed in the interior space of the housing 11. The wheels 9 are respectively supported on (by) the main body 2 via the suspension apparatuses 30. The suspension apparatuses 30 support the wheels 9 such that at least a portion of each wheel 9 protrudes downward beyond (below) the bottom surface 2B, as will be further discussed below. When the wheels 9 are placed on the surface to be cleaned FL, the bottom surface 2B of the main body 2 opposes the surface to be cleaned FL with a gap or spacing therebetween.

Referring now to FIGS. 2 and 3 together, the main brush 16 is disposed in the suction port (main brush opening) 15 and opposes the surface to be cleaned FL. The main brush 16 is elongated in the left-right direction. The main brush 16 comprises a rod 16R, which extends in the left-right direction, and a plurality of brushes (bristles) 16B connected to an outer surface of the rod 16R and extending radially therefrom. A left end part and a right end part of the rod 16R are each rotatably supported by the main body 2. The rod 16R is supported by the main body 2 such that at least some of the brushes 16B (i.e. some of the bristles) protrude downward beyond (below) the bottom surface 2B. Thus, when the wheels 9 are placed on the surface to be cleaned FL, at least some of the brushes (bristles) 16B of the main brush 16 contact the surface to be cleaned FL.

The main brush motor 17 generates motive power that rotates the main brush 16 using electric power supplied from the batteries 3. The main brush motor 17 is disposed in the interior space of the housing 11.

The two side brushes 18 are disposed on the front part of the bottom surface 2B and also oppose the surface to be cleaned FL. One of the side brushes 18 is provided leftward of the suction port 15 and the other side brush 18 is provided rightward of the suction port 15. The side brushes 18 each comprise a plurality of brushes (bristles) 18B connected to a disk 18D in a radially extending manner. The disks 18D are rotatably supported on (by) the main body 2 such that at least a portion of some of the brushes (bristles) 18B protrudes outward of (beyond) the side surface 2C. When the wheels 9 are placed on the surface to be cleaned FL, at least a portion of the brushes (bristles) 18B of each of the side brushes 18 contacts the surface to be cleaned FL.

The side brush motors 19 generate motive power that respectively rotate the side brushes 18 using electric power supplied from the batteries 3. The side brush motors 19 are disposed in the interior space of the housing 11. Rotation of the side brushes 18 causes dust, debris, etc., which is present on the surface to be cleaned FL in the vicinity of the main body 2, to be moved toward the suction port 15.

Referring now to FIG. 1, the handle 22 is provided on the front part of the upper housing 11A. Opposite end parts of the handle 22 are pivotably coupled to the upper housing 11A. Therefore, the user can lift and carry the robotic vacuum 1 by holding the handle 22.

The user interface 23 is disposed on the rear part of the cover plate 11C. The user interface 23 comprises a plurality of operation parts, which are operated (e.g., manually manipulated) by the user, and a plurality of display parts. Power supply button 23A is an illustrative example of an operation part of the user interface 23. Display parts 23B, which indicate the remaining battery charge of the batteries 3, are illustrative examples of the display parts of the user interface 23. In addition, a light emitting part 24, which includes, for example, a light emitting diode, is provided on the front part of the upper housing 11A and serves to indicate when the robotic vacuum 1 is in operation.

Storage Unit

Figure 4:
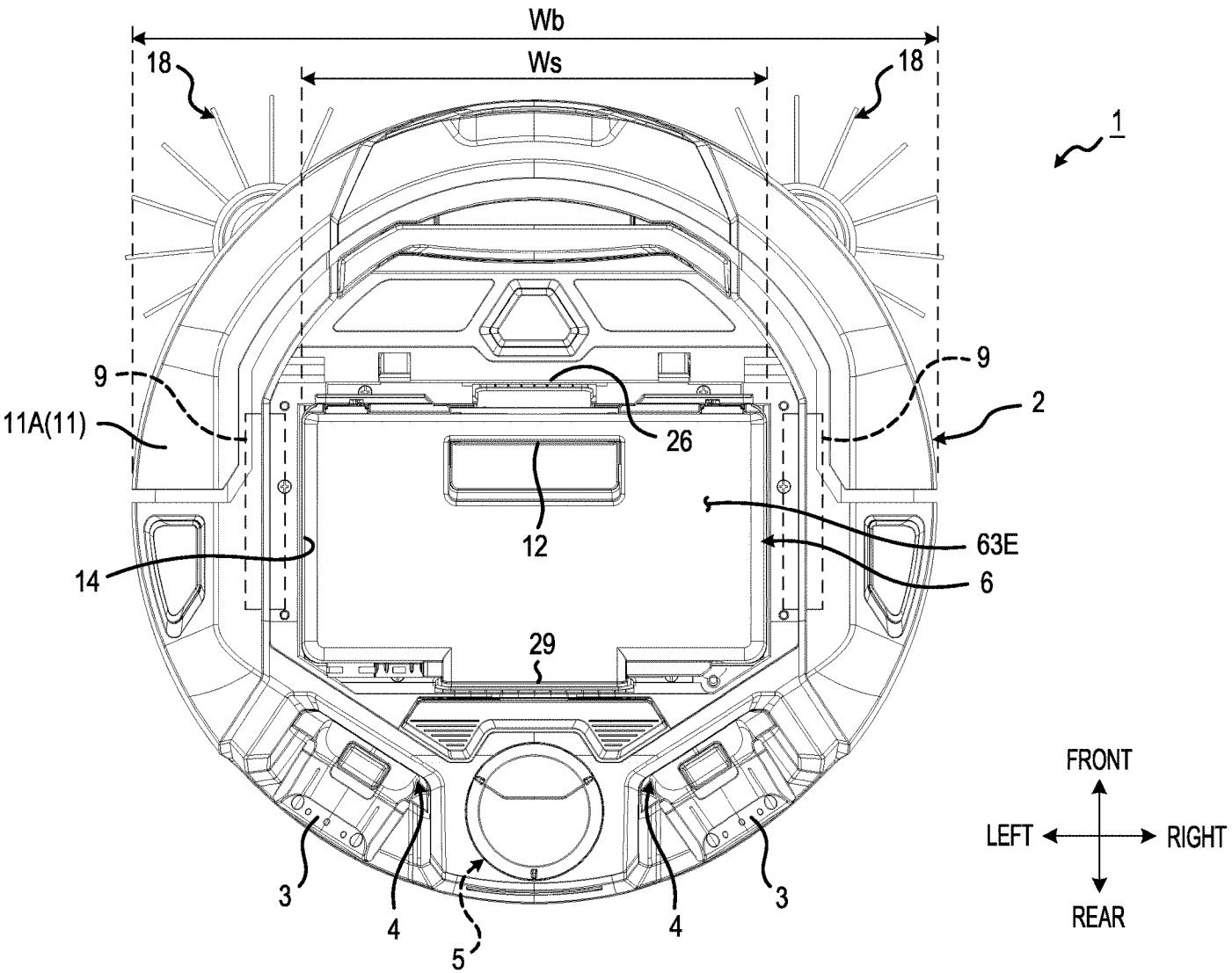
FIG. 4 is a top view that shows the robotic vacuum according to the first exemplary embodiment.

FIG. 4 is a top view that shows the robotic vacuum 1 according to the present embodiment with the cover plate 11C removed from the upper housing 11A.

The upper housing 11A has an opening 14, through which the storage unit 6 can pass. The opening 14 is provided in a central part of the upper housing 11A. The cover plate 11C is disposed such that it closes up the opening 14 of the upper housing 11A. As shown in FIG. 4, when the cover plate 11C is removed from the upper housing 11A, the storage unit 6 becomes visible. The user can remove the storage unit 6 from the interior space of the housing 11 through the opening 14. In addition, the user can house (place) the storage unit 6 in the interior space of the housing 11 by passing it through the opening 14.

In the present embodiment, a storage unit handle 12 is provided on an upper part of the storage unit 6. The storage unit handle 12 includes a recessed or open part, into which the user's fingers can be placed (slid) to grasp the storage unit handle 12. When the user has grasped the storage unit handle 12, the user can remove the storage unit 6 from the interior space of the housing 11 or place the storage unit 6 into the interior space of the housing 11.

As was noted above, the two wheels 9 are provided in the left-right direction. As shown in FIG. 4, the storage unit 6 is disposed between the two wheels 9 in the left-right direction, which is parallel to the rotational axis AX.

Figure 5:
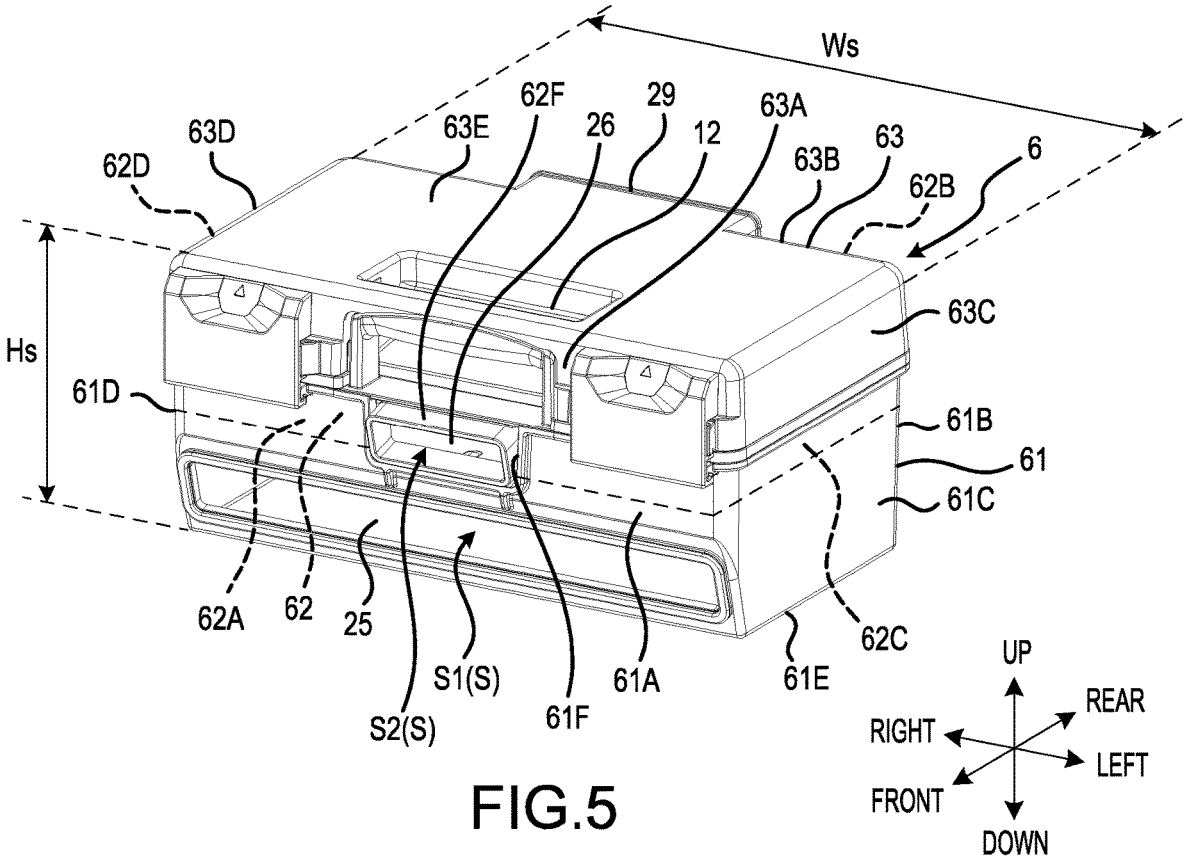
FIG. 5 is an oblique view that shows a storage unit according to the first exemplary embodiment.

FIG. 5 in an oblique view that shows the storage unit 6 according to the present embodiment removed from the main body 2. As shown in FIGS. 3 and 5, the storage unit 6 comprises: a main body 61; a tray 62, which is disposed on an upper end part of the main body 61; and a cover 63, which is disposed on an upper end part of the tray 62.

The main body 61 comprises: a front plate 61A; a rear plate 61B, which is disposed rearward of the front plate 61A; a left plate 61C, which connects a left end portion of the front plate 61A to a left end portion of the rear plate part 61B; a right plate 61D, which connects a right end portion of the front plate 61A to a right end portion of the rear plate 61B; and a bottom plate 61E, which connects a lower end portion of the front plate 61A, a lower end portion of the rear plate 61B, a lower end portion of the left plate 61C, and a lower end portion of the right plate 61D. An opening is provided in an upper portion of the main body 61.

The tray 62 is disposed such that it closes up the opening of the upper portion of the main body 61. The tray 62 comprises: a front plate 62A; a rear plate 62B, which is disposed rearward of the front plate 62A; a left plate 62C, which connects a left end portion of the front plate 62A to a left end portion of the rear plate 62B; a right plate 62D, which connects a right end portion of the front plate 62A to a right end portion of the rear plate 62B; and a bottom plate 62E, which connects a lower end portion of the front plate 62A, a lower end portion of the rear plate 62B, a lower end portion of the left plate 62C, and a lower end portion of the right plate 62D. An opening is provided in the upper end portion of the tray 62.

The cover 63 is disposed such that it closes up the opening of the upper portion of the tray 62. Thus, the tray 62 is disposed between the main body 61 and the cover 63 in the up-down direction. The cover 63 comprises: a front plate 63A; a rear plate 63B, which is disposed rearward of the front plate 63A; a left plate 63C, which connects a left end portion of the front plate part 63A to a left end portion of the rear plate 63B; a right plate 63D, which connects a right end portion of the front plate part 63A to a right end portion of the rear plate 63B; and a top plate 63E, which connects an upper end portion of the front plate 63A, an upper end portion of the rear plate 63B, an upper end portion of the left plate 63C, and an upper end portion of the right plate 63D. The rear plate 61B of the main body 61 and the rear plate 63B of the cover 63 are coupled via a hinge mechanism.

Referring now to FIGS. 3 and 5 together, the interior of the storage unit 6 includes a storage space S. The dust, debris, etc. suctioned in through the suction port 15 is stored in the storage space S of the storage unit 6. In the present embodiment, the storage space S includes a lower side storage space 51, which is defined as the space between the main body 61 and the tray 62, and an upper side storage space S2, which is defined as the space between the tray 62 and the cover 63. Thus, the upper side storage space S2 is located upward of the lower side storage space S1.

The storage unit 6 has a lower side collection port (opening) 25, which is fluidly connected to (in fluid communication with) the lower side storage space S1 and collects (holds) a portion of the dust, debris, etc. suctioned in through the suction port 15. In addition, the storage unit 6 has an upper side collection port (opening) 26, which is fluidly connected to (in fluid communication with) the upper side storage space S2 and collects (holds) another portion of the dust, debris, etc. suctioned in through the suction port 15, as will be further explained below. Finally, the storage unit 6 also has an exhaust port 29, which is fluidly connected to (in fluid communication with) the upper side storage space S2 and through which air from the upper side storage space S2 is exhausted.

The lower side collection port 25 is provided in the front plate 61A of the main body 61. In the present embodiment, the lower side collection port 25 has a rectangular shape that is elongated in the left-right direction.

The upper side collection port 26 is disposed upward of the lower side collection port 25. The upper side collection port 26 is provided in the front plate 62A of the tray 62. In the left-right direction, the dimension (length) of the upper side collection port 26 is smaller (less) than the dimension (length) of the lower side collection port 25. In the left-right direction, the center of the lower side collection port 25 coincides (is vertically aligned) with the center of the upper side collection port 26.

In the present embodiment, the tray 62 comprises a tube 62F, which protrudes forward from the front plate 62A. The upper side collection port 26 is disposed at a front end portion of the tube 62F. The front plate 61A of the main body 61 has a recess (groove, slot) 61F, in which the tube 62F is disposed.

The exhaust port 29 is disposed rearward of the lower side collection port 25 and the upper side collection port 26. The exhaust port 29 is provided in the rear plate 62B of the tray 62.

As shown in FIG. 3, the main body 2 has a lower side passageway 27, which fluidly connects the suction port 15 to the lower side collection port 25, and an upper side passageway 28, which fluidly connects the suction port 15 to the upper side collection port 26. Thus, the lower side storage space S1 is fluidly connected to (in fluid communication with) the suction port 15 via the lower side collection port 25 and the lower side passageway 27. On the other hand, the upper side storage space S2 is fluidly connected to (in fluid communication with) the suction port 15 via the upper side collection port 26 and the upper side passageway 28. Thus, the lower side passageway 27 and the upper side passageway 28 act as a branch for dividing the dust, debris, etc. that is suctioned in via the suction port 15, as will be further discussed below.

The exhaust port 29 is fluidly connected to the air suction port 5D of the fan unit 5. The fan unit 5 is fluidly connected to (in fluid communication with) the suction port 15 via the exhaust port 29, the upper side storage space S2, and the upper side passageway 28. In addition, a filter 20, which traps dust, is disposed between the exhaust port 29 and the upper side storage space S2. It is noted that the exhaust port 29 is not fluidly connected to the lower side storage space S1 and the lower side passageway 27, as will be explained below.

Operation

Next, a representative, non-limiting method for operating the robotic vacuum 1 will be explained. When the wheels 9 contact the surface to be cleaned FL, portions of the main brush 16 and the side brushes 18 contact the surface to be cleaned FL. Electric power output from the batteries 3 is supplied to the wheel motors 10, the suction motor 5C, the main brush motor 17, and the side brush motors 19.

In this state, when electric power is supplied from the batteries 3 to the wheel motors 10 and thereby the wheels 9 rotate, the robotic vacuum 1 travels autonomously on the surface to be cleaned FL.

When electric power is supplied from the batteries 3 to the suction motor 5C and the suction fan 5B rotates, an airflow is generated from the air suction port 5D toward the exhaust port 5E. As was noted above, the air suction port 5D is fluidly connected to (in fluid communication with) the suction port 15 via the upper side storage space S2 of the storage unit 6 and the upper side passageway 28. Consequently, when the suction fan 5B rotates, an airflow is generated from the suction port 15 toward the exhaust port 5E through the upper side passageway 28 and the upper side storage space S2. Thereby, a suction force for suctioning dust is generated at (in) the suction port 15.

When electric power is supplied from the batteries 3 to the main brush motor 17 and the main brush 16 rotates, dust, debris, etc., on the surface to be cleaned FL is scooped or swept up by the main brush 16. At least some of the dust scooped or swept up by the main brush 16 is suctioned through the suction port 15.

When electric power is supplied from the batteries 3 to the side brush motors 19 and the side brushes 18 rotate, dust, debris, etc. present on the surface to be cleaned FL in the vicinity of the main body 2 is moved toward the suction port 15 by the side brushes 18. At least some of the dust, debris, etc., which was moved toward the suction port 15 by the side brushes 18 and was then scooped or swept up by the main brush 16, which is also suctioned through the suction port 15.

Relatively small size dust and/or lightweight dust that is/are suctioned in via the suction port 15 is conveyed to the upper side storage space S2 through the upper side passageway 28 and the upper side collection port 26, owing to the fact that the light and/or small particles are lifted by the suction force that draws such light and/or small particles upward. Such dust is then stored in the upper side storage space S2. Because the filter 20 is provided between the upper side storage space S2 and the exhaust port 29, the dust that was conveyed to the upper side storage space S2 through the upper side collection port 26 is trapped by the filter 20 and remains in the upper side storage space S2. After the air that was suctioned in through the suction port 15 passes through the filter 20, it is conveyed to the fan unit 5 through the exhaust port 29. The air conveyed to the fan unit 5 is exhausted through the exhaust port 5E.

On the other hand, relatively large size and/or heavy dust, debris, etc. is/are scooped or swept up by the main brush 16 and is then conveyed to the lower side storage space 51 through the lower side passageway 27 and the lower side collection port 25 owing to the fact that the suction force communicated by the upper side collection port 26 is not strong enough to pull such large and/or heavy particles or objects upward into the upper side storage space S2. Therefore, such large and/or heavy dust, debris, objects, etc. are stored in the lower side storage space S1. The lower edge of the lower side collection port 25 is disposed at a location higher than the bottom plate 61E of the main body 61. Consequently, the dust, debris, objects, etc. stored in the lower side storage space S1 is inhibited (impeded, blocked) from flowing in reverse (falling out) back into the lower side passageway 27. Thus, this split storage unit 6 design is advantageous, because larger and/or heavier particles are separated from lighter dust, debris, etc. This design thus leads to power savings, because larger, heavier particles are swept up into the lower side storage space S1 whereas smaller, lighter particles are suctioned into the upper side storage space S2, thereby leading to higher efficiency dust and debris collection. Additionally, two storage spaces S1, S2 provide an efficient use of the storage space overall, because continuation of dust and debris collection is possible even if one storage space S1 or S2 is full.

Dimensions of Parts

Next, preferred dimensions of each part of the robotic vacuum 1 will be explained. In the following description, the width of the main body 2 is represented by Wb, the width of the storage unit 6 is represented by Ws, the height of the main body 2 is represented by Hb, and the height of the storage unit 6 is represented by Hs.

The width Wb is the dimension (linear length) of the main body 2 in the left-right direction, which is parallel to the rotational axis AX of the wheels 9. That is, the width Wb is the distance in the left-right direction between the leftmost side of the main body 2 and the rightmost side of the main body 2. In the present embodiment, the width Wb is the distance in the left-right direction between the leftmost side of the side surface 2C of the main body 2 and the rightmost side of the side surface 2C of the main body 2.

The width Ws is the dimension (linear length) of the storage unit 6 in the left-right direction, which is parallel to the rotational axis AX of the wheels 9. That is, the width Ws is the distance in the left-right direction between the leftmost side of the storage unit 6 and the rightmost side of the storage unit 6. In the present embodiment, the width Ws is the width of the cover 63. It is noted that the width Ws may be the width of the main body 61.

The height Hb is the dimension (linear length) of the main body 2 in the up-down direction, which is orthogonal to the rotational axis AX of the wheels 9. That is, the height Hb is the distance in the up-down direction between the uppermost side of the main body 2 and the lowermost side of the main body 2. In the present embodiment, the height Hb is the distance in the up-down direction between the uppermost side of the upper surface 2A of the main body 2 and the lowermost side of the bottom surface 2B of the main body 2.

The height Hs is the dimension (linear length) of the storage unit 6 in the up-down direction, which is orthogonal to the rotational axis AX of the wheels 9. That is, the height Hs is the distance in the up-down direction between the uppermost side of the storage unit 6 and the lowermost side of the storage unit 6. In the present embodiment, the height Hs is the distance in the up-down direction between an upper surface of the top plate 63E of the cover 63 and a lower surface of the bottom plate 61E of the main body 61.

In the present embodiment, the width Wb of the main body 2 is preferably 470 mm or more and 600 mm or less. In addition, the height Hb of the main body 2 is preferably 130 mm or more and 300 mm or less. That is, in the present embodiment, the robotic vacuum 1 preferably satisfies the conditions of equation (1) and/or equation (2) below.

$$470\text{ mm} \le Wb \le 600\text{ mm} \quad (1)$$

$$130\text{ mm} \le Hb \le 300\text{ mm} \quad (2)$$

In addition or in the alternative, in the present embodiment, the robotic vacuum 1 preferably satisfies the conditions of equation (3) and/or equation (4) below.

$$0.5 \times Wb \le Ws \le 0.7 \times Wb \quad (3)$$

$$0.5 \times Hb \le Hs \le 1.0 \times Hb \quad (4)$$

The width of the suction port 15 is represented by Wi. The width Wi is the dimension of the suction port 15 in the left-right direction, which is parallel to the rotational axis AX of the wheels 9. That is, the width Wi is the distance (linear length) in the left-right direction between the leftmost side of the suction port 15 and the rightmost side of the suction port 15. In the present embodiment, the robotic vacuum 1 preferably also satisfies the condition of equation (5) below.

$$0.9 \times Wo \le Ws \le 1.1 \times Wi \quad (5)$$

In addition, the dimension (linear length) Wj of the suction port 15 in the front rear direction is preferably 10% or more and 20% or less of the width Wi, i.e. $0.1 \times Wi \le Wj \le 0.2 \times Wi$.

Advantages and Effects

As explained above, the robotic vacuum 1 according to the present embodiment preferably satisfies the conditions of all of equations (1) to (4). In this case, the robotic vacuum 1 can more easily clean larger surface areas than robotic vacuums for home use for the reasons that will be explained below.

Figure 6:
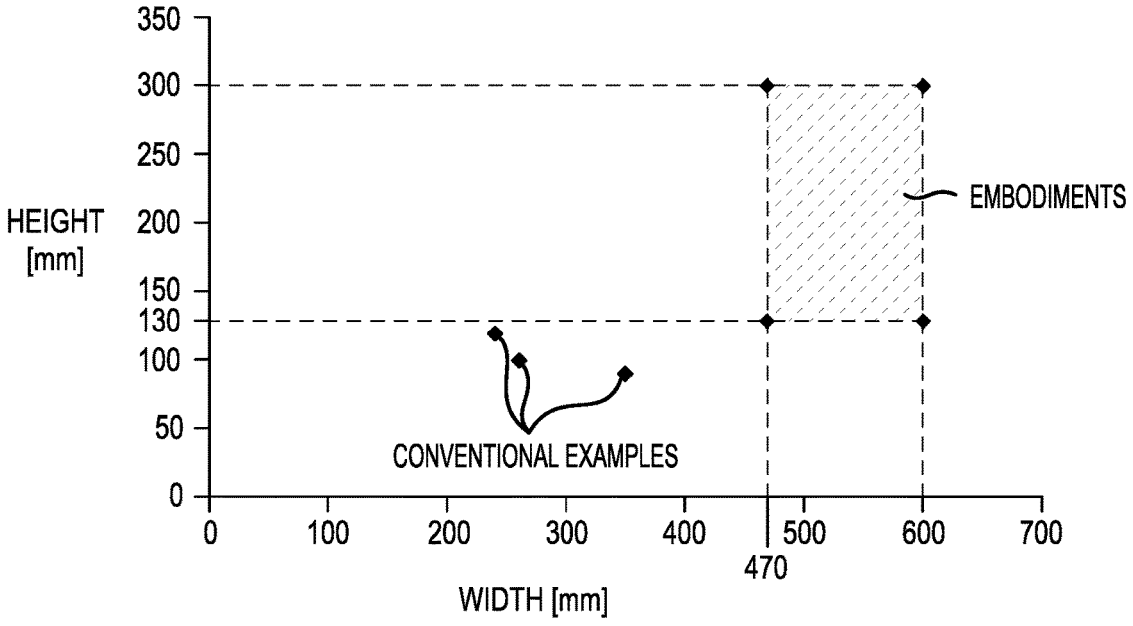
FIG. 6 is a graph for explaining the preferred dimensions of the robotic vacuum according to the first exemplary embodiment.

FIG. 6 is a graph for explaining the dimensions of the robotic vacuum 1 according to the present embodiment as compared to conventional examples of robotic vacuums for home use. In the graph shown in FIG. 6, the abscissa represents the width of the main body of the robotic vacuum, and the ordinate represents the height of the main body of the robotic vacuum. In FIG. 6, the three conventional example plots (points) are typical dimensions of conventional robotic vacuums for home use.

As shown in FIG. 6, the widths of the conventional robotic vacuums for home use are 350 mm or less, and the heights of the conventional robotic vacuums for home use are 120 mm or less. The surface area of a surface to be cleaned by a robotic vacuum for home use is smaller than the surface area of the surface to be cleaned FL cleaned by the robotic vacuum for business use. For example, the occupied area of a typical apartment is often in the range of 60-100 $m^2$. In addition, for the robotic vacuum to smoothly travel autonomously on the surface to be cleaned in a home, the robotic vacuum is preferably small in size. Taking into consideration the relatively small surface area of the surface to be cleaned in a home and the desire for smooth autonomous travel, the width of robotic vacuums for home use is usually set to 350 mm or less, and the height is usually set to 120 mm or less.

On the other hand, the robotic vacuum 1 according to the present embodiment is designed as a robotic vacuum for business use that is intended to clean a floor surface FL, e.g., of a store, an office, a factory, a distribution warehouse, an airport, etc., which is much larger than typical surfaces to be cleaned in homes. The surface area of the surface to be cleaned FL cleaned by the robotic vacuum 1 according to the present embodiment may, for example, about 500 $m^2$ or more and is thus much larger than the surface area to be cleaned in a home.

Consequently, the ability to efficiently clean a relatively large area surface in a short time can be given as one non-limiting example of a performance requirement of the robotic vacuum 1 according to the present embodiment. As was noted above, in the present embodiment, the width Wb is 470 mm or more and the height Hb is 130 mm or more. That is, the width Wb and the height Hb of the main body 2 of the robotic vacuum 1 according to the present embodiment are sufficiently larger than the width and height of the main body of a robotic vacuum for home use. Accordingly, the robotic vacuum 1 can efficiently clean the large area surface to be cleaned FL in a short time.

In addition, the ability of a user to easily carry the robotic vacuum 1 can be given as another non-limiting example of a performance requirement of the robotic vacuum 1 according to the present embodiment. If multiple discrete or spaced apart surface areas are to be cleaned and/or if the surface to be cleaned FL has multiple levels (e.g. different floors of a building), then it is convenient if the user can easily carry the robotic vacuum 1. In the present embodiment, because the width Wb is 600 mm or less and the height Hb is 300 mm or less, the robotic vacuum 1 is not too bulky and thus a user can easily carry the robotic vacuum 1.

In addition, for example, the aisle passageway width in a car of a Shinkansen bullet train or other types of railway trains is approximately 600 mm. The width of passageways between adjacent desks in an office and the width of passageways between adjacent shelves in a store, such as a convenience store, is usually greater than 600 mm. Because the width Wb of the main body 2 is 600 mm or less and the height Hb is 300 mm or less, the robotic vacuum 1 can smoothly travel autonomously through the passageways described above.

That is, in the present embodiment, the width Wb and the height Hb of the main body 2 are specified as the largest possible value, within a range in which the user can easily carry the robotic vacuum 1 while it is also able to efficiently clean a large area surface FL. The present inventors discovered that, when the width Wb and the height Hb of the main body 2 satisfy the conditions of equation (1) and equation (2), it is possible to provide a robotic vacuum 1 such that the robotic vacuum 1 can be easily carried by the user and it can efficiently clean a large area surface FL. If the width Wb were to be (hypothetically) less than 470 mm or the height Hb were to be (hypothetically) less than 130 mm, then the dimensions of the main body 2 would be too small, and consequently it would become difficult for a robotic vacuum 1 for business use to efficiency clean a large area surface FL. On the other hand, if the width Wb were to be (hypothetically) greater than 600 mm or the height Hb were to be (hypothetically) greater than 300 mm, then the robotic vacuum 1 might become difficult (too bulky) to carry or it might become difficult for the robotic vacuum 1 to smoothly travel autonomously through passageways of narrow width and/or of low height. Thus, if the robotic vacuum 1 satisfies the conditions of equation (1) and equation (2), it is possible to easily and smoothly clean a large area surface FL.

In addition, the ability to store a large amount of various kinds of dust and other debris (rocks, chips, work items, personal belongings, etc.) collected by the robotic vacuum 1 can be given as another non-limiting example of a performance requirement of the robotic vacuum 1 according to the present teachings. The robotic vacuum 1 according to the present embodiment can clean a large area surface FL. In addition, in a store, an office, a factory, a distribution warehouse, or the like, there is a high possibility that large amounts of large size dust/debris and heavy dust/debris, which is not typically generated in a home, will be present. Moreover, because the robotic vacuum 1 of the present embodiment is powered by two batteries 3 (e.g., preferably two 18-V lithium ion batteries that store 3.0 or more amp-hours Ah of charge), the robotic vacuum can be operated for a much longer time (before recharging is necessary) than a conventional robotic vacuum for home use, such that the robotic vacuum of the present embodiment can cover a much larger surface area during one operation. Consequently, the storage unit 6 of the robotic vacuum 1 for business use is required to store a greater volume of dust, debris, etc. than a storage unit of a robotic vacuum for home use, or else a user will be inconvenience by having to repeatedly stop and empty the robotic vacuum 1.

As described above, when the user has grasped the storage unit handle 12, the user can remove the storage unit 6 from the interior space of the housing 11 and place the storage unit 6 into the interior space of the housing 11. In the present embodiment, the width Ws and the height Hs of the storage unit 6 are specified as the largest possible values, within a range that the user can easily carry the storage unit 6, such that a large amount of dust, debris, etc. can be stored in the storage unit 6. The present inventors discovered that, when the width Ws and the height Hs of the storage unit 6 satisfy the conditions of equation (3) and equation (4), it is possible to provide a robotic vacuum 1 that can be easily carried by the user and can store a large amount of dust, debris, etc. On the other hand, if the width Ws were to be (hypothetically) less than [0.5×Wb] or the height Hs were to be (hypothetically) less than [0.5×Hb], then the dimensions (volume) of the storage unit 6 would be too small, and consequently it would become difficult for the robotic vacuum 1 for business use to store a large amount of dust, debris, etc. Moreover, if the width Ws were to be (hypothetically) greater than [0.7×Wb] or the height Hs were to be (hypothetically) greater than [1.0×Hb], then other problems would arise, such as it would become difficult for the user to carry the storage unit 6, it would become necessary to increase the size of the main body 2 commensurate with the dimensions of the storage unit 6, and the like. For example, if the width Ws of the storage unit 6 is large or the height Hs of the storage unit 6 is large, then the storage unit 6 can store a large amount of dust. However, if storage unit 6 is capable of storing an excessive amount of dust, debris, etc., then the storage unit 6 becomes heavier commensurate with the amount of dust. For example, when removing the storage unit 6 from the interior space of the housing 11, if a large amount of dust is stored in the storage unit 6, then the storage unit 6 will become excessively heavy, and consequently it will become difficult for the user to easily remove the storage unit 6. Therefore, if the robotic vacuum 1 satisfies the conditions of equation (3) and equation (4), the robotic vacuum 1 can store a relatively large amount of dust, debris, etc. while still permitting the user to easily handle the storage unit 6.

In addition, in the present embodiment, the condition of equation (5) is preferably satisfied. That is, in the present embodiment, the width Ws of the storage unit 6 and the width Wi of the suction port 15 are preferably the same or substantially the same. By making the width Wi of the suction port 15 sufficiently large, the robotic vacuum 1 can collect a large amount of dust, debris, etc. through the suction port 15. In addition, in the present embodiment, the width of the lower side collection port 25 is the same or substantially the same as the width Ws of the storage unit 6 in the left-right direction. Consequently, large size dust, debris, etc. and/or heavy dust, debris, etc. scooped or swept up by the main brush 16 can smoothly move to the lower side storage space S1 through the lower side collection port 25.

In addition, in the present embodiment, batteries 3 for power tools are used as the power supply of the robotic vacuum 1. Consequently, it is advantageous from a cost perspective and from the standpoint of ease of management. In addition, in the present embodiment, the battery mounting parts 4 are provided on at least a portion of the outer surface of the main body 2. Consequently, the user can easily and quickly mount the batteries 3 on the battery mounting parts 4 and remove the batteries 3 from the battery mounting parts 4 on the exterior of the housing 11, because it is not necessary to remove any kind of battery cover.

It is noted that, in the present embodiment, the robotic vacuum 1 is preferably configured to satisfy all the conditions of equations (1)-(5). However, the robotic vacuum 1 optionally may satisfy only one or some of the conditions of equation (1), equation (2), equation (3), equation (4), and equation (5). For example and without limitation, the robotic vacuum 1 may satisfy only the conditions of equation (1) and equation (3), the robotic vacuum 1 may satisfy only the conditions of equation (2) and equation (4), the robotic vacuum 1 may satisfy only the conditions of equation (1) and equation (2), etc.

Second Embodiment

A second embodiment, which includes three modified examples of the first embodiment described above, will now be explained. In the explanation below, structural elements the same as or equivalent to those in the first embodiment described above are assigned the same reference numbers and symbols, and explanations thereof are abbreviated or omitted.

MODIFIED EXAMPLE 1

In the first embodiment described above, the dimensions of the storage unit 6 were specified based on the dimensions of the main body 2, i.e. the dimensions of the storage unit 6 were defined relative to the dimensions of the main body 2. On the other hand, in Modified Example 1, the dimensions of the storage unit 6 are specified in absolute terms. More specifically, the width Ws of the storage unit 6 preferably may be 280 mm or more and 420 mm or less, and the height Hs of the storage unit 6 preferably may be 130 mm or more and 300 mm or less. That is, the storage unit 6 may satisfy the conditions of equation (6) and/or equation (7) below.

$$280\text{ mm} \le Ws \le 420\text{ mm} \quad (6)$$

$$130\text{ mm} \le Hs \le 300\text{ mm} \quad (7)$$

On the other hand, if the width Ws were to be (hypothetically) less than 280 mm or the height Hs were to be (hypothetically) less than 130 mm, then the dimensions of the storage unit 6 would be too small, and consequently it would become difficult for the robotic vacuum 1 for business use to store a large amount of dust, debris, etc. Moreover, if the width Ws were to be (hypothetically) greater than 420 mm or the height Hs were to be (hypothetically) greater than 300 mm, then it would become difficult for the user to carry the storage unit 6, it would become necessary to increase the size of the main body member 2 commensurate with the dimensions of the storage unit 6, and the like. A storage unit 6 that satisfies the conditions of equation (6) and equation (7) does not exist in conventional robotic vacuums for home use. By virtue of the robotic vacuum 1 of Modified Example 1 satisfying the conditions of equation (6) and equation (7), the robotic vacuum 1 of Modified Example 1 can store a large amount of dust, debris, etc. and the user can easily handle the storage unit 6.

MODIFIED EXAMPLE 2

In addition or in the alternative, the capacity Q of the storage unit 6 may be set to 2.0 liters or more and 5.0 liters or less. The capacity Q of the storage unit 6 is the sum of the volume of the lower side storage space S1, which is defined by the main body 61 and the tray 62, and the volume of the upper side storage space S2, which is defined by the tray 62 and the cover 63. That is, the storage unit 6 may satisfy the condition of equation (8) below.

$$2.0\text{ liters} \le Q \le 5.0\text{ liters} \quad (8)$$

On the other hand, if the capacity Q were to be (hypothetically) less than 2.0 liters, then the capacity Q of the storage unit 6 would be too small, and consequently it would become difficult for a robotic vacuum 1 for business use to store a large amount of dust. Moreover, if the capacity Q were to be (hypothetically) greater than 5.0 liters, then it would become difficult for the user to carry the storage unit 6, it would become necessary to increase the size of the main body 2 commensurate with the capacity Q of the storage unit 6, and the like. A storage unit 6 that satisfies the condition of equation (8) does not exist in conventional robotic vacuums for home use. By virtue of the robotic vacuum 1 satisfying the condition of equation (8), the robotic vacuum 1 of Modified Example 2 can store a large amount of dust, debris, etc., and the user can easily handle the storage unit 6.

MODIFIED EXAMPLE 3

In addition or in the alternative, if the height Hb of the main body 2 is 130 mm or more and 300 mm or less (i.e. 130 mm≤Hb≤300 mm), then the width Wb and the height Hb of the main body 2 may preferably satisfy the condition of equation (9) below.

$$2.6 \times Hb \leq Wb \leq 4.0 \times Hb \quad (9)$$

On the other hand, if the width Wb of the main body 2 were to be (hypothetically) less than [2.6×Hb], then the width Wb of the main body 2 would be too small, and consequently it would become difficult for a robotic vacuum 1 for business use to efficiently clean a large area surface FL. In addition, it would be necessary to reduce the dimensions of the storage unit 6 housed in the main body 2, and therefore the storage unit 6 could no longer store a large amount of dust, debris, etc. Moreover, if the width Wb were to be (hypothetically) larger than [4.0×Hb], then the width Wb of the main body 2 would be too large, and consequently there would be a possibility that it would become difficult for the user to carry the robotic vacuum 1, it would become difficult for the robotic vacuum 1 to smoothly travel autonomously through narrow passageways, and the like. A storage unit 6 that satisfies the condition of equation (9) does not exist in conventional robotic vacuums for home use. By virtue of the robotic vacuum 1 satisfying the condition of equation (9), the robotic vacuum 1 of Modified Example 3 can easily and smoothly clean the large area surface to be cleaned FL.

Third Embodiment

A third embodiment will now be explained. In the explanation below, structural elements that are identical or equivalent to those in the embodiment described above are assigned the same reference numbers and symbols, and explanations thereof are abbreviated or omitted.

Suspension Apparatus

Figure 7:
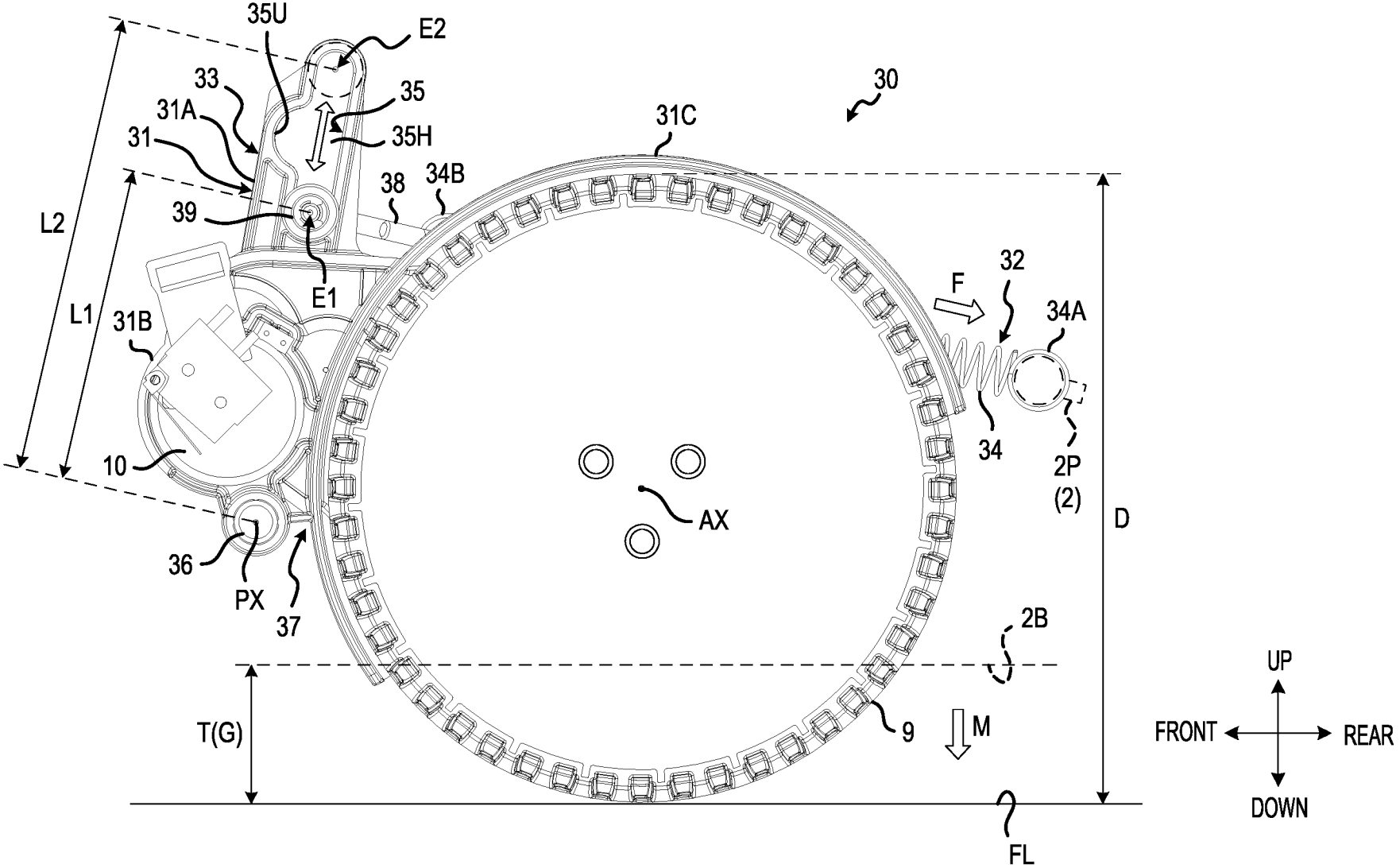
FIG. 7 is a view that shows a suspension apparatus, which supports a wheel, according to a third, non-limiting exemplary embodiment of the present teachings.
Figure 8:
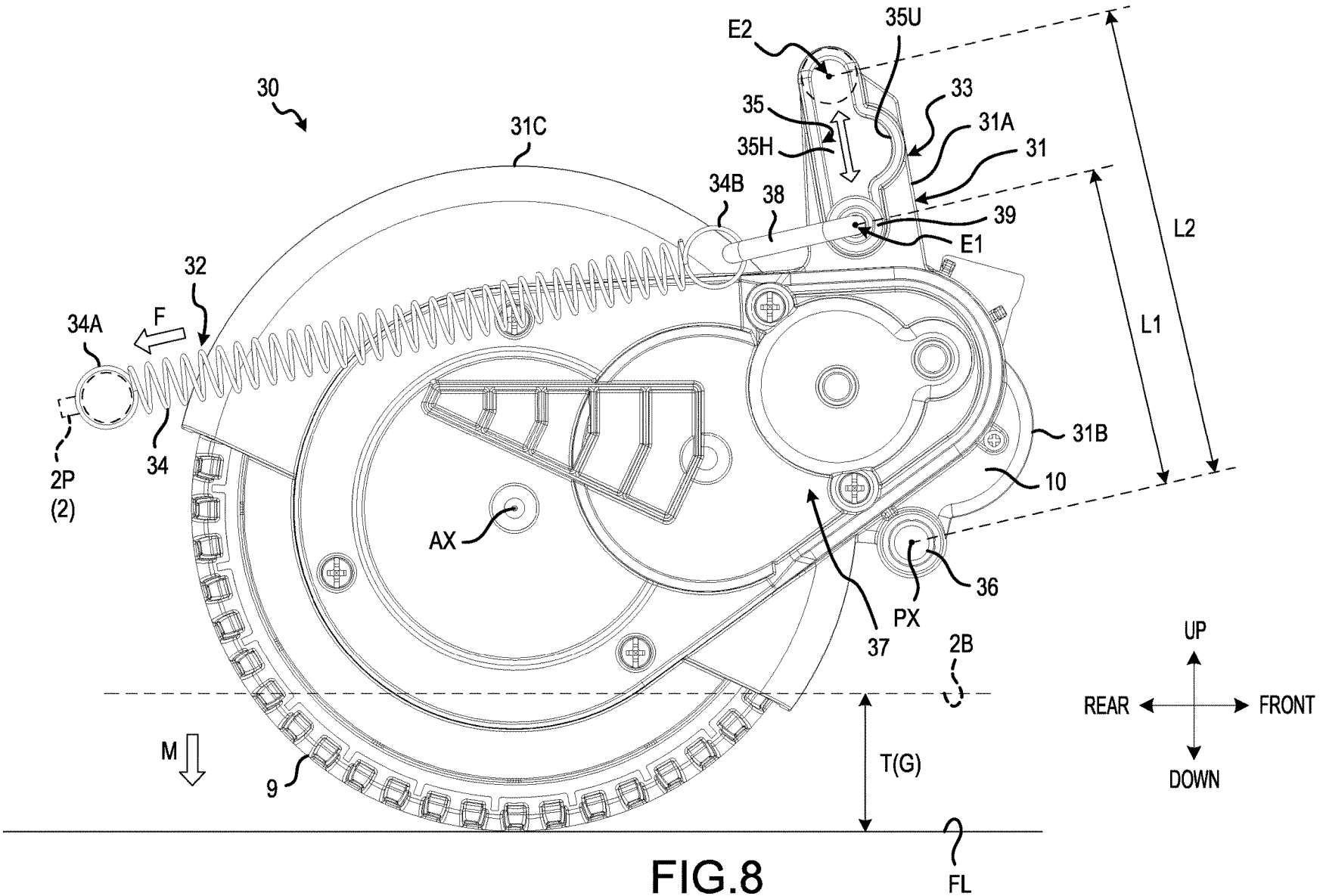
FIG. 8 is another view of the suspension apparatus according to the third exemplary embodiment.

In the present third embodiment, further details concerning the exemplary suspension apparatuses 30 will be explained. FIGS. 7 and 8 are views that show one of the suspension apparatuses 30, which supports one of the wheels 9, according to the third embodiment. FIG. 7 is a view of the wheel 9 and the suspension apparatus 30 as viewed from the left side, and FIG. 8 is a view of the wheel 9 and the suspension apparatus 30 as viewed from the right side. Both suspension apparatuses 30 may be constructed identically or in a mirror-symmetric manner. Also, in the following description, although the wheel 9, the suspension apparatus 30 and components thereof may be referred to in the singular, it is understood that the description applies to both wheels 9, both suspension apparatuses 30 and the components thereof unless expressly indicated otherwise.

As shown in FIGS. 7 and 8, the suspension apparatus 30 comprises: a support member 31, which supports the wheel 9 so that it is rotatable about the rotational axis AX; a motive force generating mechanism 32, which imparts (applies) a motive force (e.g., a spring force) F to the support member 31 to generate a downwardly-directed biasing force M that causes the wheel 9 to protrude beyond (below) the bottom surface 2B of the main body 2; and an adjusting mechanism 33, which adjusts the biasing force M in accordance with (based on) the amount T of protrusion of the wheel 9 beyond (below) the bottom surface 2B. Thus, the suspension apparatus 30 imparts (applies) a biasing force M, which has been adjusted by the adjusting mechanism 33, to the wheel 9.

In the present third embodiment, the motive force generating mechanism 32 comprises a spring 34, which is preferably a coil spring, although another type of resiliently elastic member (e.g. a linear rubber band) may be used as the motive force generating mechanism 32 instead of or in addition to the coil spring. A first end 34A of the spring 34 is coupled to a hook 2P, which is provided on (e.g., affixed to or integral with) the main body 2.

The suspension apparatus 30 further comprises a support member 36 that supports the support member 31 so that the support member 31 is pivotable about a pivot axis (fulcrum) PX, which is set to be located, within a plane orthogonal to the rotational axis AX, at a position that differs (is displaced or offset) from the rotational axis AX. The rotational axis AX extends in the left-right direction. The pivot axis PX is preferably set to be forward of the rotational axis AX. The support part 36 comprises a pin, which is fixed to or integral with the main body 2. The support member 31 is supported by (on) the main body 2 so as to be pivotable about the pivot axis PX that is defined by the pin (support part 36).

The adjusting mechanism 33 comprises a guide part 35, which movably guides a second end 34B of the spring 34. The guide part 35 is provided on (e.g., is affixed to or integral with) the support member 31. The second end 34B of the spring 34 moves the guide part 35 by pivoting the support member 31.

A guide hole 35H passes (penetrates) through the support member 31 in the left-right direction. The guide part 35 includes an inner surface of the guide hole 35H. The guide part 35 is flat and is elongated (extends) substantially in the up-down (vertical) direction.

The second end 34B of the spring 34 is coupled to a roller 39 via a coupling member 38, which may be, e.g., a rod with hooks on both ends or a structure having a ring-, oval- or stadium-shape. The first end 34A of the spring 34 is disposed rearward of the second end 34B. The roller 39 is guided by the guide part 35 such that the guide part 35 and the roller 39 are movable relative to one another. The roller 39 is capable of moving such that it slides or rolls along the guide part 35. Because the roller 39 is guided by the guide part 35, the second end 34B of the spring 34 also is guided by the guide part 35.

The roller 39 is disposed in the guide hole 35H. Flanges are provided on a right end and a left end of the roller 39. The flanges are respectively disposed on the outer sides of the guide hole 35H and respectively oppose the side surfaces of the support member 31. Because the flanges respectively contact the side surfaces of the support member 31, the roller 39 is impeded (blocked) from slipping out of the guide hole 35H. A recess (depression) 35U is provided in (along) a portion of the guide hole 35H. The inner diameter of the recess 35U is larger than the outer diameter of the flange of the roller 39. Therefore, to insert the roller 39 into the guide hole 35H, the roller 39 is passed through the guide hole 35H at the recess 35U and then moved downward toward the base or bottom of the guide hole 35H. Thereafter, the coupling member 38 may be coupled to the right and left ends of the roller 39. Because the spring 34 tensions (pulls) the roller 39 rearward, the roller 39 moves along the flat rearward side of the guide hole 35H during operation, and thus never enters the recess 35U during operation.

The roller 39, while being guided by the guide part 35, is capable of moving between a lower end portion E1 and an upper end portion E2 of the guide part 35. Thus, the guide part 35 comprises the flat rearward side of the guide hole 35H between the lower end portion E1 and the upper end portion E2. When the roller 39 moves from the lower end portion E1 to the upper end portion E2 of the guide part 35 or vice versa, the second end 34B of the spring 34 moves in the up-down direction relative to the main body 2. On the other hand, the first end 34A of the spring 34 is fixed to the main body 2. Therefore, the second end 34B of the spring 34 is a movable end that moves the guide part 35 (and thus also moves the support member 31), and the first end 34A of the spring 34 is a fixed end.

The wheel motor 10 is supported by the support member 31. In this regard, it is noted that the support member 31 comprises: a first portion 31A, in which the guide part 35 is provided; a second portion 31B, which supports the wheel motor 10; and a third portion 31C, which is disposed partially around the wheel 9. The guide part 35 is provided (located) upward of the pivot axis PX. In the up-down direction, the wheel motor 10 is provided (located) between the guide part 35 and the pivot axis PX. Furthermore, the wheel motor 10 is disposed forward of the wheel 9. The motive power (rotational drive) generated by the wheel motor 10 is transmitted (operably coupled) to a motive power transmission mechanism 37 that comprises a plurality of gears, which operably (mechanically) couple an output shaft of the wheel motor 10 to the wheel 9.

As was noted above, the support member 31 is supported by the main body 2 so as to be pivotable about the pivot axis PX, which is disposed downward of the guide part 35. When the support member 31 pivots about the pivot axis PX, the wheel 9 moves in the up-down direction relative to the main body 2, whereby the amount T of protrusion of the wheel 9 beyond (below) the bottom surface 2B changes.

Figure 9A:
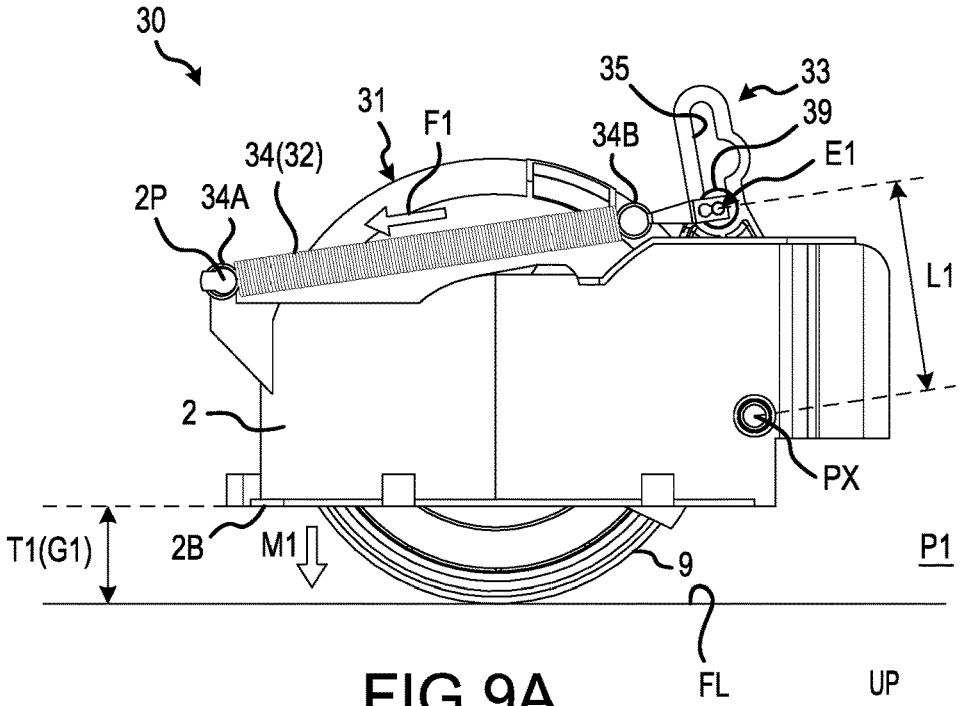
FIGS. 9A and 9B are views that respectively show two modes of operation of the suspension apparatus according to the third exemplary embodiment.
Figure 9B:
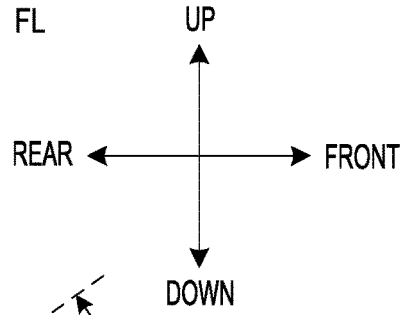

Referring now to FIGS. 9A and 9B, the suspension apparatus 30 supports the wheel 9 such that it is moveable in the up-down direction between a first protrusion position P1 (FIG. 9A), at which the wheel 9 protrudes beyond the bottom surface 2B by a first protrusion amount T1, and a second protrusion position P2 (FIG. 9B), at which the wheel 9 protrudes beyond the bottom surface 2B by a second protrusion amount T2 that is greater than the first protrusion amount T1. The first protrusion position P1 is the position, within the movable range of the wheel 9 in the up-down direction, at which the amount T of protrusion of the wheel 9 beyond the bottom surface 2B is smallest. On the other hand, the second protrusion position P2 is the position, within the movable range of the wheel 9 in the up-down direction, at which the amount T of protrusion of the wheel 9 beyond the bottom surface 2B is largest.

When the wheel 9 contacts the surface to be cleaned FL and the wheel 9 is disposed at the first protrusion position P1, the distance G1 between the bottom surface 2B of the robotic vacuum 1 and the surface to be cleaned FL is the shortest (FIG. 9A). On the other hand, when the wheel 9 contacts the surface to be cleaned FL and the wheel 9 is disposed at the second protrusion position P2, the distance G2 between the bottom surface 2B of the robotic vacuum 1 and the surface to be cleaned FL is the longest (FIG. 9B).

When the support member 31 pivots about the pivot axis PX, the roller 39 and the guide part 35 move relative to one another. By virtue of the relative movement of the roller 39 and the guide part 35, the second end 34B of the spring 34, which is coupled to the roller 39 via the coupling member 38, moves relative to the guide part 35. Thus, when the second end 34B of the spring 34 moves, the distance L (i.e. L1 and L2 in FIGS. 9A and 9B, respectively) between the pivot axis PX and the roller 39 (and thus also the second end 34B of the spring 34) changes.

Within a plane orthogonal to the pivot axis PX, the distance L1 between the pivot axis PX and the lower end portion E1 of the guide part 35 is shorter than the distance L2 between the pivot axis PX and the upper end portion E2 of the guide part 35. That is, the distance L2 is longer than the distance L1.

In the explanation below, the position of the lower end portion E1 is called the first guide position E1 when appropriate, and the position of the upper end portion E2 is called the second guide position E2 when appropriate. The roller 39 moves between the first guide position E1, which is spaced apart from the pivot axis PX by the distance L1 (a first distance), and the second guide position E2, which is spaced apart from the pivot axis PX by the distance L2 (a second distance) that is longer than the distance L1. Owing to this movement of the roller 39, the second end 34B of the spring 34 also moves relative to the pivot axis PX.

In the present third embodiment, the motive force F that the motive force generating mechanism 32 imparts (applies) to the support member 31 is an elastic (spring) force applied by the spring 34 pulling (tensioning) the support member 31. That is, the spring 34 generates an elastic (spring) force that pulls (pivots) the support member 31 about the pivot axis PX in a tangential direction of a circle having the pivot axis PX as its center. In the explanation below, the motive force F is called the elastic force F when appropriate.

When the roller 39 is disposed at the first guide position E1, the spring 34 generates a first elastic force F1 (FIG. 9A). On the other hand, when the roller 39 is disposed at the second guide position E2, the spring 34 generates a second elastic force F2 (FIG. 9B). The elastic force F (F1, F2) is proportional to the amount of elongation (i.e. the length) of the spring 34.

In the present third embodiment, the amount of elongation of the spring 34 when the roller 39 is disposed at the first guide position E1 is larger than the amount of elongation of the spring 34 when the roller 39 is disposed at the second guide position E2. It is noted that the amount of elongation of the spring 34 when the roller 39 is disposed at the first guide position E1 may be equal to the amount of elongation of the spring 34 when the roller 39 is disposed at the second guide position E2.

Figure 9B:
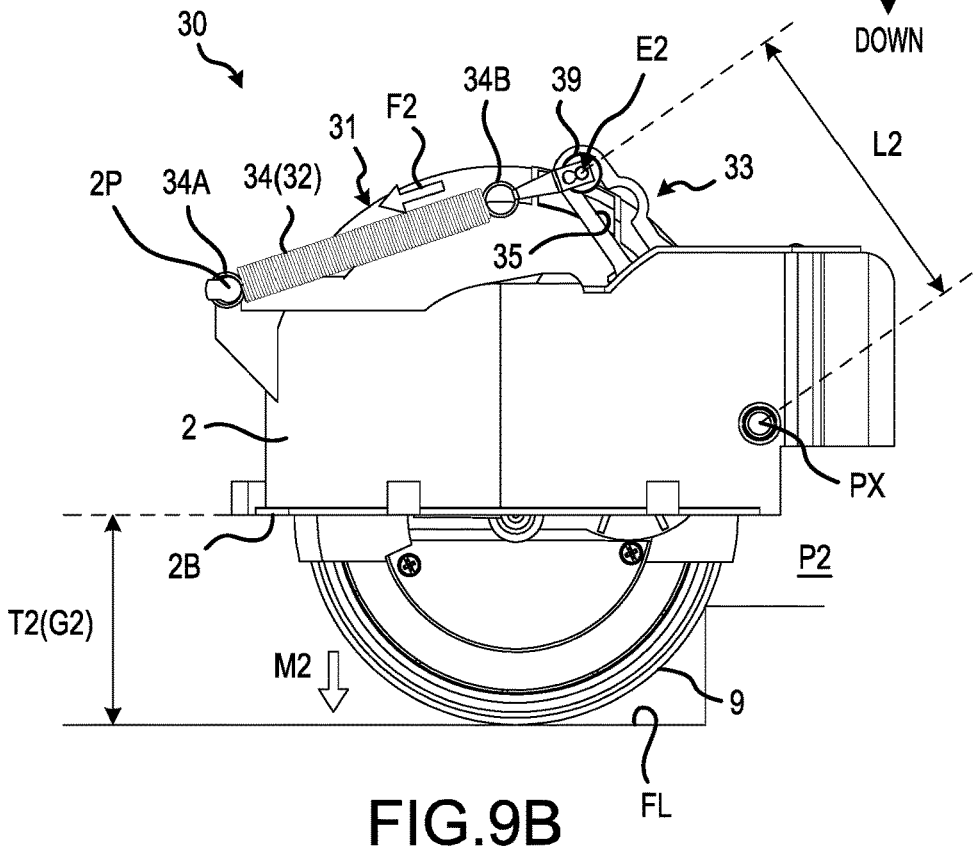

As was indicated above, FIG. 9 includes two views that show examples of two modes of the operation of the suspension apparatus 30 according to the present third embodiment. More specifically, FIG. 9A shows the state in which the wheel 9 is disposed at the first protrusion position P1 and FIG. 9B shows the state in which the wheel 9 is disposed at the second protrusion position P2. In addition, the two views of FIGS. 9A and 9B show a portion of the main body 2.

More specifically, as shown in FIG. 9A, for example, when the robotic vacuum 1 travels autonomously on a flat surface to be cleaned FL, the support member 31 pivots about the pivot axis PX owing to the intrinsic weight of the main body 2 and thereby the roller 39 moves to the first guide position E1 of the guide part 35. When the roller 39 has moved to the first guide position E1, the wheel 9 is disposed, within the movable range of the wheel 9 in the up-down direction, at the first protrusion position P1. The first protrusion position P1 is the position of the wheel 9 at which the amount T of protrusion of the wheel 9 beyond (below) the bottom surface 2B is the smallest.

On the other hand, as shown in FIG. 9B, for example, when the robotic vacuum 1 contacts and then travels up (moves over) a difference in level of the surface to be cleaned FL, the support member 31 is caused to pivot about the pivot axis PX and thereby the roller 39 moves to the second guide position E2. Owing to the pivoting of the support member 31 about the pivot axis PX such that roller 39 can move to the second guide position E2, the wheel 9 is caused to move relative to the main body 2 such that the wheel 9 is disposed, within the movable range of the wheel 9 in the up-down direction, at the second protrusion position P2. The second protrusion position P2 is the position of the wheel 9 at which the amount T of protrusion of the wheel 9 beyond the bottom surface 2B is the largest.

When the wheels 9 of the robotic vacuum 1 are in contact with the surface to be cleaned FL and the wheels 9 are rotated by the wheel motors 10, the robotic vacuum 1 travels autonomously on the surface to be cleaned FL. If the robotic vacuum 1 travels autonomously on a flat surface to be cleaned FL, then, as shown in FIG. 9A, each roller 39 is disposed at the first guide position E1 and thus each wheel 9 is disposed at the first protrusion position P1, whereby the bottom surface 2B is spaced apart from the surface to be cleaned FL by the distance G1. On the other hand, if the surface to be cleaned FL has a difference in level (e.g., a bump, an area rug, a small step, etc.), when the robotic vacuum 1 contacts and then travels up (moves over) the difference in level, each roller 39 is caused to move to and be disposed at the second guide position E2 owing to the pivoting of the support member 31, whereby each wheel 9 will be disposed at the second protrusion position P2 relative to the main body 2 as shown in FIG. 9B. Consequently, the bottom surface 2B of the robotic vacuum 1 will be spaced apart from the surface to be cleaned FL by the distance G2, which is longer (greater) than the distance G1. That is, at least the portion of the main body 2 adjacent to the wheels 9 is caused to rise up (away) from (or elevate relative) to the surface to be cleaned FL when the robotic vacuum encounters a difference in level of the surface to be cleaned FL.

To generate the biasing force M that causes the wheel 9 to protrude beyond the bottom surface 2B, the spring 34 imparts (applies) the elastic force F to the support member 31. The elastic force F causes the wheel 9 to be pushed against the surface to be cleaned FL.

The spring 34 generates the elastic force F so as to pull (tension) the support member 31 rearward about the pivot axis PX in a tangential direction of a circle having the pivot axis PX as its center. When the roller 39 is disposed at the first guide position E1, the spring 34 generates the first elastic force F1 in proportion to the larger amount of elongation (longer length) of the spring 34 shown in FIG. 9A. On the other hand, when the roller 39 is disposed at the second guide position E2, the spring 34 generates the second elastic force F2 in proportion to the short amount of elongation (shorter length) of the spring 34 shown in FIG. 9B. Thus, the first elastic force F1 is greater than the second elastic force F2 owing to the greater displacement of the spring 34 from its resting or relaxed configuration in the configuration shown in FIG. 9A as compared to the configuration shown in FIG. 9B.

The biasing force M, which causes the wheel 9 to protrude beyond (below) the bottom surface 2B, is defined by the product of the elastic force F of the spring 34 applied to the support member 31 and the distance L between the pivot axis PX and the point of action at which the elastic force F of the spring 34 acts upon the support member 31. That is, the biasing force M, which causes the wheel 9 to protrude beyond the bottom surface 2B, is the moment of force that rotates the support member 31 about the pivot axis PX in proportion to the elastic force F of the spring 34. In the present embodiment, the point of action at which the elastic force F of the spring 34 acts upon the support member 31 is the position of the roller 39.

When the roller 39 is positioned at the first guide position E1 and the roller 39 and the pivot axis PX are spaced apart by the distance L1, the biasing force M1 is defined by the product of the distance L1 and the first elastic force F1. When the roller 39 is positioned at the second guide position E2 and the roller 39 and the pivot axis PX are spaced apart by the distance L2, the biasing force M2 is defined by the product of the distance L2 and the second elastic force F2.

That is, when the robotic vacuum 1 travels autonomously on a flat surface to be cleaned FL, the biasing force M1 is applied to the wheel 9. When the robotic vacuum 1 travels up (moves over) a difference in level, the biasing force M2 is applied to the wheel 9. Thus, in the present embodiment, the biasing force M is adjusted in accordance with the state (e.g., flat or level surface to be cleaned versus raised or inclined surface to be climbed) of the surface to be cleaned FL.

Figure 10:
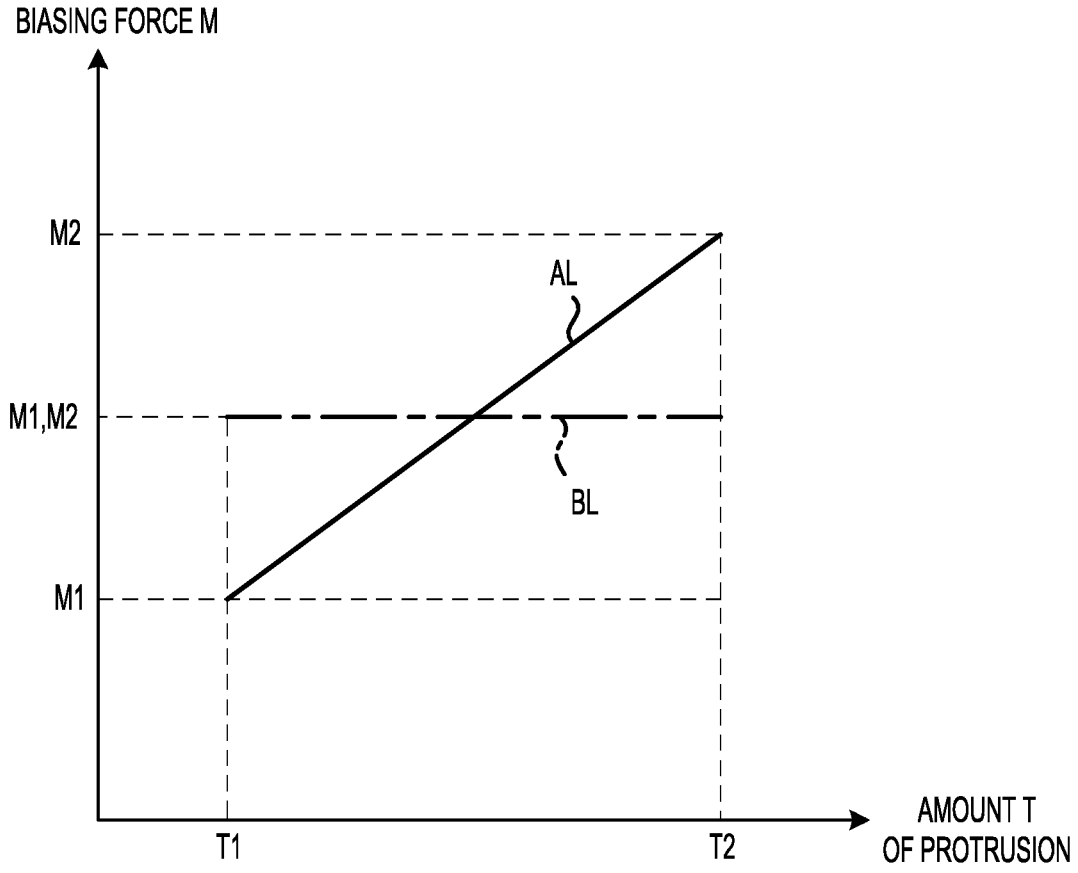
FIG. 10 is a graph that shows the relation (change or variation) of a biasing force relative to an amount of protrusion of the wheel according to the third exemplary embodiment.

FIG. 10 is a graph that shows a relation (change or variation) of the biasing force M with respect to the amount T of protrusion according to the present embodiment. In the graph shown in FIG. 10, the abscissa represents the amount T of protrusion of the wheel 9 beyond (below) the bottom surface 2B of the robotic vacuum 1, and the ordinate represents the biasing force M applied to the wheel 9. As shown by line AL in FIG. 10, the adjusting mechanism 33 of the present embodiment may be configured such that the biasing force M2, which is applied to the wheel 9 when it is disposed at the second protrusion position P2 (i.e. the wheel 9 is protruding by the second protrusion amount T2) is greater than the biasing force M1 applied to the wheel 9 when it is disposed at the first protrusion position P1 (i.e., when the wheel 9 is protruding by the first protrusion amount T1).

If the robotic vacuum 1 is traveling autonomously on a flat surface to be cleaned FL, then the small biasing force M1 is applied to the wheel 9. Because the biasing force M1 is small, the distance G1 between the bottom surface 2B and the surface to be cleaned FL is shortened. Thereby, the main body 2 is inhibited from rising up from the surface to be cleaned FL, such that the robotic vacuum 1 can travel stably. In addition, because the distance between the suction port 15 and the surface to be cleaned FL is shortened, the main brush 16 and the side brushes 18 can make sufficient contact with the surface to be cleaned FL. Accordingly, the robotic vacuum 1 can satisfactorily clean the surface to be cleaned FL.

On the other hand, if the robotic vacuum 1 travels up (moves over) a difference in level of the surface to be cleaned FL, then the larger biasing force M2 may be applied to the wheel 9. As was noted above, the biasing force M causes the wheel 9 to be pressed against the surface to be cleaned FL. When the larger biasing force M2 is being applied to the wheel 9, the wheel 9 can sufficiently grip the surface to be cleaned FL and the difference in level (elevation). Consequently, the wheel 9 is less likely to slip, e.g., as it travels up and over the difference in level.

Dimensions of Parts

Given that the amount of protrusion of the wheel 9 beyond the bottom surface 2B is represented by T, and the diameter of the wheel 9 is represented by D, in the present third embodiment, the robotic vacuum 1 preferably satisfies the conditions of equation (10) and/or equation (11) below.

$$0.1 \times Hs \leq T \leq 0.4 \times Hs \quad (10)$$

$$0.4 \times Hs \leq D \leq 1.2 \times Hs \quad (11)$$

In equation (10), the amount T of protrusion is the protrusion amount (the first protrusion amount T1) when the wheel 9 is disposed at the first protrusion position P1, as was explained above with reference to FIG. 9A.

In equations (10) and (11), the height Hs is 130 mm or more and 300 mm or less. It is noted that the height Hs may be less than 130 mm or may be greater than 300 mm.

It is noted that the amount T of protrusion of the wheel 9 beyond the bottom surface 2B is preferably 15 mm or more and 50 mm or less. In addition, the diameter D of the wheel 9 is preferably 100 mm or more and 150 mm or less. That is, the robotic vacuum 1 preferably satisfies the conditions of equation (12) and/or equation (13) below.

$$15\ \text{mm} \leq T \leq 50\ \text{mm} \tag{12}$$

$$100\ \text{mm} \leq D \leq 150\ \text{mm} \tag{13}$$

Advantages and Effects

As explained above, according to the present third embodiment, each suspension apparatus 30, which supports one of the wheels 9, comprises: the support member 31, which rotatably supports the wheel 9 about the rotational (central) axis AX; the motive force generating mechanism 32, which imparts (applies) the motive force F (i.e., the elastic force F) to the support member 31 to generate the biasing force M that causes the wheel 9 to protrude beyond (below) the bottom surface 2B of the main body 2; and the adjusting mechanism 33, which adjusts the biasing force M based on the amount T of protrusion of the wheel 9 beyond the bottom surface 2B. Thereby, even if the amount T of protrusion of the wheel 9 beyond the bottom surface 2B changes in accordance with the state of the surface to be cleaned FL, because the biasing force M is being adjusted based on the amount T of protrusion of the wheel 9 from the bottom surface 2B, the suspension apparatus 30 can apply an appropriate biasing force M to the wheel 9. In the present third embodiment, when the robotic vacuum 1 travels autonomously on a flat surface to be cleaned FL, the small biasing force M1 is applied to the wheel 9. Consequently, the main body 2 of the robotic vacuum 1 is inhibited from rising up from the surface to be cleaned FL, and thereby the robotic vacuum 1 can stably travel autonomously while cleaning efficiently and effectively. On the other hand, when the wheels 9 of the robotic vacuum 1 contact and then travel up (move over) a difference in level of the surface to be cleaned FL, then the larger biasing force M2 is applied to the wheel 9. Consequently, the wheel 9 can securely grip the surface to be cleaned FL, thereby reducing the likelihood that the wheel 9 will slip, e.g., as it travels over the difference in level.

In addition, according to the present embodiment, as was shown in equations (10) and (11), the amount T of protrusion of the wheel 9 and the diameter D of the wheel 9 are defined based on the height Hs of the storage unit 6. The greater the height Hs of the storage unit 6, the larger the amount T of protrusion and the diameter D. The lower the height Hs of the storage unit 6, the smaller the amount T of protrusion and the diameter D. Thereby, the robotic vacuum 1 can travel autonomously on the surface to be cleaned FL in a stable manner.

In addition, in a robotic vacuum 1 in which the conditions of equation (10) and equation (11) and, preferably, the conditions of equations (12) and (13) are satisfied, the amount T of protrusion of the wheel 9 and the diameter D of the wheel 9 are sufficiently large. The amount T of protrusion and the diameter D according to the present embodiment do not exist in conventional robotic vacuums for home use. Because the amount T of protrusion of the wheel 9 and the diameter D of the wheel 9 are sufficiently large, even if a difference in level of the surface to be cleaned FL is relatively large, the robotic vacuum 1 can smoothly travel up and over the difference in level. There is a higher possibility that such a large difference in level exists in a store, an office, a factory, a distribution warehouse, or the like, but does not exist in a home. The robotic vacuum 1 according to the present embodiment can smoothly travel up and over such a larger difference in level.

If the amount T of protrusion of the wheel 9 were to be less than [0.1×Hs] or if the diameter D of the wheel 9 were to be less than [0.4×Hs], then it would be more difficult for the robotic vacuum 1 to travel up and over a large difference in level. On the other hand, if the amount T of protrusion of the wheel 9 were to be larger than [0.4×Hs], then there is a risk that the suction port 15 and the surface to be cleaned FL might separate too much during operation, whereby it would become more difficult for the suction port 15 to suction in dust, debris, etc. on the surface to be cleaned FL. In addition, if the diameter D of the wheel 9 were to be larger than [1.2×Hs], then the diameter D of the wheel 9 would adversely become excessively large relative to the storage unit 6. As a result, it might become more difficult for the robotic vacuum 1 to travel autonomously in a stable manner.

Similarly, if the amount T of protrusion of the wheel 9 were to be less than 15 mm or if the diameter D of the wheel 9 were to be less than 100 mm, then it might become more difficult for the robotic vacuum 1 to travel up and over a large difference in level. On the other hand, if the amount T of protrusion of the wheel 9 were to be greater than 50 mm, then there is a risk that the suction port 15 and the surface to be cleaned FL might separate too much during operation, whereby it would become difficult for the suction port 15 to suction in dust, debris, etc. on the surface to be cleaned FL. In addition, if the diameter D of the wheel 9 were to be larger than 150 mm, then the diameter D of the wheel 9 would adversely become too large relative to the storage unit 6, whereby it might become more difficult for the robotic vacuum 1 to travel autonomously in a stable manner.

According to the present embodiment, by preferably satisfying equations (10) to (13), the robotic vacuum 1 can effectively collect dust, debris, etc. while traveling autonomously in a stable manner.

In addition, in the present embodiment, the motive force generating mechanism 32 comprises the spring 34 configured such that the first end 34A is coupled (fixed) to the main body 2 and the second end 34B is movably guided by the guide part 35. The amount T of protrusion of the wheel 9 beyond the bottom surface 2B changes in accordance with the pivoting of the support member 31, and the second end 34B of the spring 34 moves the guide part 35 by pivoting the support member 31. Thereby, the distance L between the second end 34B of the spring 34 and the pivot axis PX changes. By virtue of the distance L changing, the biasing force M, which is defined by the product of the elastic force F of the spring 34 and the distance L, is adjusted.

For example, if the guide part 35 were not provided on the support member 31 and if the position of the second end 34B of the spring 34 relative to the support member 31 were fixed, then, even if the support member 31 pivoted about the pivot axis PX, the distance L between the second end 34B of the spring 34 and the pivot axis PX would not change. If the support member 31 pivoted and the wheel 9 were disposed at the second protrusion position P2, then, even though the spring 34 would contract and the elastic force F2 would become smaller, the distance L would not become longer, and therefore the biasing force M would become too small. As a result, when the wheels 9 of the robotic vacuum 1 contact a difference in level of the surface to be cleaned FL, it is more likely that the wheels 9 would not be able to securely grip the surface to be cleaned FL at the point of the level difference (elevation) and therefore slippage would occur. On the other hand, if a spring 34 having a large elastic force F were to be used (in order to provide an increased biasing force M in this situation), then the biasing force M applied to the wheel 9 would become much larger during normal operation on a flat surface, thereby causing the main body 2 to be raised up too far from the surface to be cleaned FL. In this case, it would be difficult for the robotic vacuum 1 to travel autonomously in a stable manner with adequate suctioning force at the suction port 15.

In the present embodiment, the biasing force M is appropriately adjusted based on the amount T of protrusion of the wheel 9 beyond the bottom surface 2B. Consequently, the robotic vacuum 1 can travel autonomously in a stable manner both on flat surfaces and when traveling up and over a difference in level of the surface to be cleaned FL.

In addition, in the present embodiment, the roller 39 moves between the first guide position E1 and the second guide position E2. Consequently, because the movable range of the second end 34B of the spring 34 connected to the roller 39 is prescribed, an appropriate biasing force M can be always achieved within the movable range of the second end 34B.

It is noted that, as shown by line BL in FIG. 10, the adjusting mechanism 33 may instead be configured such that the difference between the biasing force M1 applied to the wheel 9 when it protrudes by the first protrusion amount T1 and the biasing force M2 applied to the wheel 9 when it protrudes by the second protrusion amount T2 may be small or even M1 may be equal (or substantially equal) to M2 across the entire range of amounts T of protrusion of the wheel 9. That is, in such an embodiment, the adjusting mechanism 33 may be configured to adjust the biasing force M such that the biasing force M1 and the biasing force M2 are always equal or substantially equal (e.g., within a range of difference of +/−10%, more preferably +/−5%). As was described above, the biasing force M is defined by the product of the elastic force F and the distance L. The distance L1 and the distance L2 may be prescribed and the elastic force F1 and the elastic force F2, which change based on the amount of elongation (length) of the spring 34, may be prescribed such that the difference between the biasing force M1 (F1×L1) and the biasing force M2 (F2×L2) becomes small or is zero (or nearly zero) for any amount T of protrusion of the wheel 9 during normal operation of the robotic vacuum 1. The distance L (L1, L2) and the elastic force F (F1, F2) can be adjusted by modifying the structures of the guide part 35, such as, for example, the slope angle and/or the length of the guide part 35.

That is, by suitably modifying the structures, etc. of the guide part 35, it is possible to arbitrarily set the relationship between the biasing force M and the amount T of protrusion of the wheel 9 beyond (below) the bottom surface 2B. For example, the structures, etc. of the guide part 35 may be modified, e.g., based on the number or weight of the batteries 3 mounted on the robotic vacuum 1, such that an appropriate biasing force M is achieved.

It is noted that, in the embodiments described above, the biasing force M is adjusted by the second end 34B of the spring 34 moving the guide part 35 by pivoting the support member 31. In a modified example of such an embodiment, the adjusting mechanism 33 may be provided with an actuator, and a biasing force M having an appropriate relation (change or variation) with respect to the amount T of protrusion of the wheel 9 from the bottom surface 2B may be applied to the wheel 9 by actuating the actuator. For example, the actuator, which is supported by the main body 2, may apply a motive force to the support member 31. By adjusting the motive force generated by the actuator, the relation (change or variation) of the biasing force M is adjusted.

It is noted that, in the present embodiment, the robotic vacuum 1 satisfies both conditions of equation (10) and equation (11) and also both conditions of equation (12) and equation (13). However, the robotic vacuum 1 may, e.g., satisfy only the condition of equation (10), only the condition of equation (11), only the condition of equation (12), or only the condition of equation (13) or the conditions of two or more (but less than all) of equations (10)-(13).

Additional representative embodiments of the present teachings include, but are not limited to:

1. A robotic vacuum (1) comprising:

a main body (2) having a suction port (15) in a bottom surface (2B) thereof; a storage unit (6) housed in the main body and adapted to store dust and debris suctioned in via the suction port (15); and at least one wheel (9), which supports the main body (2) and at least a portion of which protrudes beyond the bottom surface (2B);

wherein:

the main body (2) has a width Wb in a first direction that is parallel to a rotational axis (AX) of the at least one wheel (9), the storage unit (6) has a width Ws in the first direction, the main body (2) has a height Hb in a second direction that is perpendicular to the rotational axis (AX) and perpendicular to the first direction, the storage unit (6) has a height Hs in the second direction, the width Wb is 470-600 mm, and the condition $0.5\times Wb \leq Ws \leq 0.7\times Wb$ is satisfied.

2. The robotic vacuum (1) according to the above embodiment 1, wherein:

the height Hb is 130-300 mm, and the condition $0.5\times Hb \leq Hs \leq 1.0\times Hb$ is satisfied.

3. A robotic vacuum (1) comprising:

a main body (2) having a suction port (15) in a bottom surface (2B) thereof;

a storage unit (6) housed in the main body and adapted to store dust and debris suctioned in via the suction port (15); and at least one wheel (9), which supports the main body (2) and at least a portion of which protrudes beyond the bottom surface (2B);

wherein:

the main body (2) has a width Wb in a first direction that is parallel to a rotational axis (AX) of the at least one wheel (9), the storage unit (6) has a width Ws in the first direction, the main body (2) has a height Hb in a second direction that is perpendicular to the rotational axis (AX) and perpendicular to the first direction, the storage unit (6) has a height Hs in the second direction, the height Hb is 130-300 mm, and the condition $0.5\times Hb \leq Hs \leq 1.0\times Hb$ is satisfied.

4. A robotic vacuum (1) comprising:

a main body (2) having a suction port (15) in a bottom surface (2B) thereof;

a storage unit (6) housed in the main body and adapted to store dust and debris suctioned in via the suction port (15); and at least one wheel (9), which supports the main body (2) and at least a portion of which protrudes beyond the bottom surface (2B);

wherein:

the main body (2) has a width Wb in a first direction that is parallel to a rotational axis (AX) of the at least one wheel (9), the storage unit (6) has a width Ws in the first direction, the main body (2) has a height Hb in a second direction that is perpendicular to the rotational axis (AX) and perpendicular to the first direction, the storage unit (6) has a height Hs in the second direction, the width Ws is 280-420 mm, and the height Hs is 130-300 mm.

5. The robotic vacuum (1) according to any one of the above embodiments 1 to 4, wherein:

the suction port (15) has a width Wi in the first direction, and the condition $0.9\times Wi \leq Ws \leq 1.1\times Wi$ is satisfied.

6. The robotic vacuum (1) according to any one of the above embodiments 1 to 5, wherein the storage unit (6) has a capacity (Q) of 2.0-5.0 liters.

7. The robotic vacuum (1) according to any one of the above embodiments 1 to 6, wherein:

the at least one wheel (9) comprises two wheels (9); and the storage unit (6) is disposed between the two wheels (9) in the first direction.

8. The robotic vacuum (1) according to any one of the above embodiments 1 to 7, wherein:

the wheel(s) protrude(s) beyond the bottom surface (2B) by an amount T, and the condition $0.1\times Hs \leq T \leq 0.4\times Hs$ is satisfied.

9. The robotic vacuum (1) according to the above embodiment 8, wherein the amount T is 15-50 mm.

10. The robotic vacuum (1) according to any one of the above embodiments 1 to 9, wherein:

the wheel has a diameter D, and the condition $0.4\times Hs \leq D \leq 1.2\times Hs$ is satisfied.

11. The robotic vacuum (1) according to the above embodiment 10, wherein the diameter D of the wheel is 100-150 mm.

12. A robotic vacuum (1) comprising:

a main body (2) having a suction port (15) in a bottom surface (2B) thereof;

a storage unit (6) housed in the main body and adapted to store dust and debris suctioned in via the suction port (15); and at least one wheel (9), which supports the main body (2) and at least a portion of which protrudes beyond the bottom surface (2B);

wherein:

the storage unit (6) has a height Hs in a direction orthogonal to a rotational axis of the at least one wheel, the at least one wheel (9) protrudes from the bottom surface (2B) by an amount T, the wheel has a diameter D, and the conditions $0.1\times Hs \leq T \leq 0.4\times Hs$ and $0.4\times Hs \leq D \leq 1.2\times Hs$ are satisfied.

13. A robotic vacuum (1) comprising:

a main body (2) having a suction port (15) in a bottom surface (2B) thereof; and at least one wheel (9), which supports the main body (2) and at least a portion of which protrudes beyond the bottom surface (2B);

wherein:

the at least one wheel (9) protrudes from the bottom surface (2B) by an amount T in the range of 15-50 mm, and the wheel has a diameter D in the range of 100-150 mm.

14. The robotic vacuum (1) according to the above embodiment 12 or 13, wherein:

the main body (2) has a width Wb in a first direction that is parallel to a rotational axis (AX) of the at least one wheel (9), the main body (2) has a height Hb in a second direction that is perpendicular to the rotational axis (AX) and perpendicular to the first direction, the width Wb is 470-600 mm, and the height Hb is 130-300 mm.

15. A robotic vacuum (1) comprising:

a main body (2) having a suction port (15) in a bottom surface (2B) thereof; and at least one wheel (9), which supports the main body (2) and at least a portion of which protrudes beyond the bottom surface (2B);

wherein:

the main body (2) has a width Wb in a first direction that is parallel to a rotational axis (AX) of the at least one wheel (9), the main body (2) has a height Hb in a second direction that is perpendicular to the rotational axis (AX) and perpendicular to the first direction, the width Wb is 470-600 mm, and the height Hb is 130-300 mm.

16. A robotic vacuum (1) comprising:

a main body (2) having a suction port (15) in a bottom surface (2B) thereof; and at least one wheel (9), which supports the main body (2) and at least a portion of which protrudes beyond the bottom surface (2B);

wherein:

the main body (2) has a width Wb in a first direction that is parallel to a rotational axis (AX) of the at least one wheel (9), the main body (2) has a height Hb in a second direction that is perpendicular to the rotational axis (AX) and perpendicular to the first direction, the height Hb is 130-300 mm, and the condition $2.6\times Hb \leq Wb \leq 4.0\times Hb$ is satisfied.

17. The robotic vacuum (1) according to any one of the above embodiments 1 to 16, further comprising:

at least one wheel motor (10) adapted to generate motive power for rotating the at least one wheel (9); and at least battery mounting part (4) adapted to mount at least one rechargeable battery (3);

wherein the at least one wheel motor (9) is driven with electric power supplied from the rechargeable battery (3).

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above and below may be utilized separately or in conjunction with other features and teachings to provide improved robotic vacuums, self-propelled, dust-collecting robots, autonomous robotic vacuum cleaners, autonomous robotic sweepers, autonomous floor-cleaning robots, etc.

Moreover, combinations of features and steps disclosed in the above detailed description, as well as in the below additional examples, may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

Although the above-described embodiments primarily concern robotic vacuums capable of sweeping and/or vacuuming dust/dirt, the present teachings are equally applicable to autonomous floor cleaning robots capable of scrubbing and/or mopping floors by providing the robot with one or more of a liquid-dispensing device, one or more scrubbers, one or more mopping cloths and/or one or more squeegees.

Although some aspects of the present invention have been described in the context of a device or apparatus, it is to be understood that these aspects also represent a description of a corresponding method, so that a block or a component of a device or apparatus is also understood as a corresponding method step or as a feature of a method step. In an analogous manner, aspects which have been described in the context of or as a method step also represent a description of a corresponding block or detail or feature of a corresponding device.

EXPLANATION OF THE REFERENCE NUMBERS

1 Robotic vacuum
2 Main body
2A Upper surface
2B Bottom surface
2C Side surface
2P Hook
3 Battery
4 Battery mounting part
5 Fan unit
5A Casing
5B Suction fan
5C Suction motor
5D Air suction port
5E Exhaust port
6 Storage unit
7 Castor
8 Roller
9 Wheel
10 Wheel motor
11 Housing
11A Upper housing
11B Lower housing
11C Cover plate
11D Bottom plate
12 Handle part
14 Opening
15 Suction port
16 Main brush
16B Brush
16R Rod
17 Main brush motor
18 Side brush
18B Brush
18D Disk
19 Side brush motor
20 Filter
22 Handle
23 User interface
23A Power supply button
23B Remaining battery charge display part
24 Light emitting part
25 Lower side collection port
26 Upper side collection port
27 Lower side passageway
28 Upper side passageway
29 Exhaust port
30 Suspension apparatus
31 Support member
31A First portion
31B Second portion
31C Third portion
32 Motive force generating mechanism
33 Adjusting mechanism
34 Spring
34A First end of spring 34
34B Second end of spring 34
35 Guide part
35H Guide hole
35U Recessed part
36 Support part
37 Motive power transmission mechanism
38 Coupling member
39 Roller
61 Storage unit main body
61A Front plate part
61B Rear plate part
61C Left plate part
61D Right plate part
61E Bottom plate part
61F Recessed part
62 Tray
62A Front plate part
62B Rear plate part
62C Left plate part
62D Right plate part
62E Bottom plate part
62F Tube part
63 Cover
63A Front plate part
63B Rear plate part
63C Left plate part
63D Right plate part
63E Top plate part
AX Rotational axis
D Diameter
E1 Lower end part (first guide position)
E2 Upper end part (second guide position)
Hb Height
Hs Height
P1 First protrusion position
P2 Second protrusion position
PX Pivot axis
S Storage space
S1 Lower side storage space
S2 Upper side storage space
T Amount of protrusion
Wb Width
Ws Width

We claim:

1. A robotic vacuum comprising:

a main body having a suction port in a bottom surface thereof;

at least one wheel supporting the main body, at least a portion of the at least one wheel protrudes below the bottom surface;

a storage unit having a lower side storage space physically separated from an upper side storage space by a tray;

a lower side collection port defined in the storage unit in fluid communication with the lower side storage space; and an upper side collection port defined in the storage unit in fluid communication with the upper side storage space;

wherein:

the main body has a width Wb in a first direction that is parallel to a rotational axis of the wheel, the main body has a height Hb in a second direction that is perpendicular to the rotational axis and perpendicular to the first direction, and the main body further comprises:

a lower side passageway fluidly connecting the suction port to the lower side collection port; and an upper side passageway fluidly connecting the suction port to the upper side collection port, the upper side passageway being isolated from the lower side passageway so that there is no fluid communication between the upper side passageway and the lower side passageway.

2. The robotic vacuum according to claim 1, wherein:

the width Wb is 470-600 mm, and the height Hb is 130-300 mm.

3. The robotic vacuum according to claim 1, wherein:

the at least one wheel protrudes from the bottom surface by an amount T in the range of 15-50 mm, and the wheel has a diameter D in the range of 100-150 mm.

4. The robotic vacuum according to claim 3, wherein:

the width Wb is 470-600 mm, and the height Hb is 130-300 mm.

5. The robotic vacuum according to claim 1, wherein:

the height Hb is 130-300 mm, and the condition $2.6 \times Hb \leq Wb \leq 4.0 \times Hb$ is satisfied.

6. The robotic vacuum according to claim 1, wherein:

the storage unit is housed in the main body and is configured to store dust and debris suctioned in via the suction port;

the storage unit has a width Ws in the first direction, and the storage unit has a height Hs in the second direction.

7. The robotic vacuum according to claim 6, wherein:

the width Wb is 470-600 mm, and the condition $0.5 \times Wb \leq Ws \leq 0.7 \times Wb$ is satisfied.

8. The robotic vacuum according to claim 7, wherein:

the height Hb is 130-300 mm, and the condition $0.5 \times Hb \leq Hs \leq 1.0 \times Hb$ is satisfied.

9. The robotic vacuum according to claim 6, wherein:

the height Hb is 130-300 mm, and the condition $0.5 \times Hb \leq Hs \leq 1.0 \times Hb$ is satisfied.

10. The robotic vacuum according to claim 6, wherein:

the width Ws is 280-420 mm, and the height Hs is 130-300 mm.

11. The robotic vacuum according to claim 6, wherein:

the suction port has a width Wi in the first direction, and the condition $0.9 \times Wi \leq Ws \leq 1.1 \times Wi$ is satisfied.

12. The robotic vacuum according to claim 6, wherein the storage unit has a capacity of 2.0-5.0 liters.

13. The robotic vacuum according to claim 6, wherein:

the at least one wheel comprises two wheels; and the storage unit is disposed between the two wheels in the first direction.

14. The robotic vacuum according to claim 6, wherein:

the at least one wheel protrudes beyond the bottom surface by an amount T, and the condition $0.1 \times Hs \leq T \leq 0.4 \times Hs$ is satisfied.

15. The robotic vacuum according to claim 14, wherein the amount T is 15-50 mm.

16. The robotic vacuum according to claim 14, wherein:

the wheel has a diameter D, and the condition $0.4 \times Hs \leq D \leq 1.2 \times Hs$ is satisfied.

17. The robotic vacuum according to claim 6, wherein:

the wheel has a diameter D, and the condition $0.4 \times Hs \leq D \leq 1.2 \times Hs$ is satisfied.

18. The robotic vacuum according to claim 17, wherein the diameter D of the wheel is 100-150 mm.

19. The robotic vacuum according to claim 6, further comprising:

at least one wheel motor configured to rotate the at least one wheel; and at least battery mounting part configured to mount at least one rechargeable battery;

wherein the at least one wheel motor is driven with electric power supplied from the rechargeable battery.

* * * * *